US010078283B2

(12) United States Patent
Shirai et al.

(10) Patent No.: US 10,078,283 B2
(45) Date of Patent: Sep. 18, 2018

(54) TONER FOR DEVELOPING ELECTROSTATIC IMAGES

(71) Applicant: Konica Minolta, Inc., Tokyo (JP)

(72) Inventors: Aya Shirai, Hino (JP); Shiro Hirano, Hachioji (JP); Junya Onishi, Hachioji (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 15/209,876

(22) Filed: Jul. 14, 2016

(65) Prior Publication Data

US 2017/0045834 A1 Feb. 16, 2017

(30) Foreign Application Priority Data

Aug. 12, 2015 (JP) ..... 2015-159382

(51) Int. Cl.

| | |
|---|---|
| ***G03G 9/08*** | (2006.01) |
| ***G03G 9/087*** | (2006.01) |
| ***G03G 9/093*** | (2006.01) |

(52) U.S. Cl.

CPC ..... *G03G 9/08755* (2013.01); *G03G 9/0806* (2013.01); *G03G 9/08711* (2013.01); *G03G 9/08724* (2013.01); *G03G 9/08728* (2013.01); *G03G 9/08797* (2013.01); *G03G 9/093* (2013.01)

(58) Field of Classification Search

CPC ..... G03G 9/08755; G03G 9/08797; G03G 9/08711; G03G 9/08724; G03G 9/0806; G03G 9/08728; G03G 9/093

See application file for complete search history.

(56) References Cited

FOREIGN PATENT DOCUMENTS

| | | | |
|---|---|---|---|
| JP | 2001222138 A | | 8/2001 |
| JP | 2007-147927 | * | 6/2007 |
| JP | 2013-11642 | * | 1/2013 |
| JP | 2014035506 A | | 2/2014 |

OTHER PUBLICATIONS

Machine Translation of JP2007-147927.*
Machine Translation of JP2014-035506.*

* cited by examiner

*Primary Examiner* — Thorl Chea
(74) *Attorney, Agent, or Firm* — Lucas & Mercanti, LLP

(57) ABSTRACT

Provided is a toner for developing electrostatic images containing a toner particle. The toner particle contains a binder resin and a release agent. The binder resin contains a vinyl resin component and a crystalline polyester resin component. The vinyl resin component has a structural unit derived from an alkyl (meth)acrylate monomer represented by Formula (1):

$$H_2C{=}CR_1{-}COOR_2 \qquad \text{Formula (1):}$$

In Formula (1), $R_1$ represents a hydrogen atom or a methyl group, and $R_2$ represents an alkyl group having 8 to 22 carbon atoms.

The crystalline polyester resin component satisfies Formula (2):

$$5 \leq |C_{acid} - C_{alcohol}| \leq 12 \qquad \text{Formula (2):}$$

In Formula (2), $C_{alcohol}$ represents the number of carbon atoms of the main chain of a structural unit derived from a polyhydric alcohol and $C_{acid}$ represents the number of carbon atoms of the main chain of a structural unit derived from a polyvalent carboxylic acid.

9 Claims, No Drawings

TONER FOR DEVELOPING ELECTROSTATIC IMAGES

This application is based on Japanese Patent Application No. 2015-159382 filed on Aug. 12, 2015 with Japan Patent Office, the entire content of which is hereby incorporated by reference.

BACKGROUND OF THE INVENTION

Field of the Invention

The present invention relates to a toner for developing electrostatic images. In particular, the present invention relates to a toner for developing electrostatic images, the toner having superior fixing properties at low temperatures and maintaining the fixing properties even after being stored at high temperatures.

Description of the Related Art

Recent electrophotographic imaging apparatuses require toners for developing electrostatic images (hereinafter may be referred to simply as "toner") having superior low-temperature fixing properties in view of high printing rate and further energy saving for a reduction in environmental load. Such a toner requires a reduction in melting temperature or melting viscosity of a binder resin contained in the toner. Several documents propose toners containing crystalline resins (e.g., crystalline polyester resins) as fixing aids and thus having improved low-temperature fixing properties (refer to, for example, Japanese Unexamined Patent Application Publication Nos. 2001-222138 and 2014-035506).

Unfortunately, the crystalline resin-containing toner disclosed in Japanese Unexamined Patent Application Publication No. 2001-222138 may cause a problem in that high compatibility between a crystalline resin component and an amorphous resin component contained in the binder resin promotes plasticization of the binder resin before thermal fixation, resulting in poor thermal resistance during storage of the toner. In contrast, low compatibility between the crystalline resin component and the amorphous resin component may lead to insufficient plasticization of the binder resin during thermal fixation. This causes insufficient low-temperature fixing properties of the toner and poor charging characteristics of the toner due to exposure of a free crystalline resin component at the surfaces of toner particles, resulting in low density and fogging of the images.

In the crystalline resin-containing toner disclosed in Japanese Unexamined Patent Application Publication No. 2014-035506, the dispersion of the crystalline resin component in toner particles is controlled through introduction of a structure having high affinity with the crystalline resin component into an amorphous resin component in the binder resin. Introduction of this structure prevents exposure of the crystalline resin component at the surfaces of the toner particles and provides the toner with superior fixing properties, thermal resistance during storage, and charging characteristics.

Unfortunately, the fixing properties of the crystalline resin-containing toner may be impaired due to accelerated crystallization of the crystalline polyester resin during transportation of the toner in high-temperature environments (e.g., 40 to 50° C.) or during storage of the toner in an image-forming apparatus at such high temperatures. Thus, a demand has arisen for a toner having superior low-temperature fixing properties and maintaining the fixing properties even after being stored at high temperature.

BRIEF SUMMARY OF THE INVENTION

An object of the present invention, which has been conceived in light of the problems and circumstances described above, is to provide a toner for developing electrostatic images, the toner having superior low-temperature fixing properties and maintaining the fixing properties even after being stored at a high temperature.

The present inventors have conducted studies for solving the aforementioned problems and have developed a toner composed of toner particles each including a binder resin, the binder resin containing a vinyl resin component having a structural unit of an alkyl (meth)acrylate monomer having a long-chain alkyl group and a crystalline polyester resin component having alkyl chains of different lengths that are repeated via ester bonds. The inventors have found that the toner has superior low-temperature fixing properties and maintains the fixing properties even after being stored at a high temperature. The present invention has been accomplished on the basis of this finding.

1. A toner for developing electrostatic images, containing:
   a toner particle including a binder resin and a release agent,
   the binder resin including a vinyl resin component and a crystalline polyester resin component,
   the vinyl resin component having a structural unit derived from an alkyl (meth)acrylate monomer represented by Formula (1):

$$H_2C{=}CR_1{-}COOR_2 \qquad \text{Formula (1):}$$

where $R_1$ represents a hydrogen atom or a methyl group, and $R_2$ represents an alkyl group having 8 to 22 carbon atoms,
   the crystalline polyester resin component satisfying Formula (2):

$$5 \le |C_{acid} - C_{alcohol}| \le 12 \qquad \text{Formula (2):}$$

where $C_{alcohol}$ represents the number of carbon atoms of the main chain of a structural unit derived from a polyhydric alcohol forming the crystalline polyester resin component and $C_{acid}$ represents the number of carbon atoms of the main chain of a structural unit derived from a polyvalent carboxylic acid forming the crystalline polyester resin component.
2. The toner for developing electrostatic images according to item 1, wherein the crystalline polyester resin component satisfies Formula (3):

$$6 \le |C_{acid} - C_{alcohol}| \le 10. \qquad \text{Formula (3):}$$

3. The toner for developing electrostatic images according to item 1, wherein the alkyl (meth)acrylate monomer has a branched structure.
4. The toner for developing electrostatic images according to item 1, wherein the crystalline polyester resin component satisfies Formula (4):

$$C_{alcohol} < C_{acid}. \qquad \text{Formula (4):}$$

5. The toner for developing electrostatic images according to item 1, wherein the crystalline polyester resin component includes a hybrid crystalline polyester resin component including a crystalline polyester resin segment bonded to an amorphous resin segment.
6. The toner for developing electrostatic images according to item 1, wherein the binder resin includes an amorphous polyester resin component.
7. The toner for developing electrostatic images according to item 6, wherein the amorphous polyester resin component includes a styrene-acrylic modified polyester resin.
8. The toner for developing electrostatic images according to item 1, wherein $R_2$ of Formula (1) is an alkyl group having eight carbon atoms.

9. The toner for developing electrostatic images according to item 1, wherein the number of carbon atoms ($C_{alcohol}$) of the main chain of the structural unit derived from the polyhydric alcohol forming the crystalline polyester resin component is 2 to 12.
10. The toner for developing electrostatic images according to item 1, wherein the number of carbon atoms ($C_{acid}$) of the main chain of the structural unit derived from the polyvalent carboxylic acid forming the crystalline polyester resin component is 6 to 16.
11. The toner for developing electrostatic images according to item 1, wherein the toner particle has a core-shell structure including a core particle coated with a shell layer.

The mechanisms and operations that establish the advantageous effects of the present invention are not clarified but are inferred as described below.

The toner of the present invention includes toner particles each containing a binder resin containing a vinyl resin component and a crystalline polyester resin component. The crystalline polyester resin component exhibits a clear endothermic peak and ensures the sharp-melting properties of the binder resin. Thus, the toner of the present invention has superior low-temperature fixing properties.

In general, the fixing properties of a toner containing a crystalline polyester resin are impaired during storage at a high temperature (e.g., 40 to 50° C.) for the following conceivable reasons. Since the crystalline polyester resin, which is fused with an amorphous resin contained in toner particles and plasticizes the surrounding resin, is readily crystallized at a high temperature, crystalline domains of the crystalline polyester resin are exposed at the surfaces of the toner particles, and the sharp-melting properties of the binder resin are impaired, resulting in poor fixing properties of the toner.

In the crystalline polyester resin component according to the present invention, the number of carbon atoms of the main chain of a structural unit derived from a polyhydric alcohol differs from that of carbon atoms of the main chain of a structural unit derived from a polyvalent carboxylic acid, and the absolute value of the difference in number of carbon atoms is 5 or more. In addition, alkyl chains of different lengths are repeated via ester bonds. Thus, the crystalline polyester resin component exhibits retarded crystallization and reduced growth of crystalline domains as compared with a common crystalline polyester resin. The vinyl resin component according to the present invention has a structural unit of an alkyl (meth)acrylate having a long-chain alkyl group, and thus exhibits appropriate affinity for the crystalline polyester resin component according to the present invention. Thus, even if the toner of the present invention is stored at a high temperature (at which a common polyester resin exhibits significant crystallization), growth of crystalline domains is reduced in the crystalline polyester resin component, and the microdispersion of the crystalline domains is maintained in toner particles.

Accordingly, the toner of the present invention has superior low-temperature fixing properties and maintains the fixing properties even after being stored at a high temperature.

DETAILED DESCRIPTION OF THE INVENTION

The toner for developing electrostatic images of the present invention includes a toner particle containing a binder resin and a release agent. The binder resin contains a vinyl resin component and a crystalline polyester resin component. The vinyl resin component has a structural unit derived from an alkyl (meth)acrylate monomer represented by Formula (1). The crystalline polyester resin component satisfies Formula (2): $5 \leq |C_{acid} - C_{alcohol}| \leq 12$ where $C_{alcohol}$ represents the number of carbon atoms of the main chain of a structural unit derived from a polyhydric alcohol forming the crystalline polyester resin component and $C_{acid}$ represents the number of carbon atoms of the main chain of a structural unit derived from a polyvalent carboxylic acid forming the crystalline polyester resin component. These technical characteristics are common in the embodiments of the present invention.

In an embodiment of the present invention, the crystalline polyester resin component preferably satisfies Formula (3) in view of achievement of the advantageous effects of the present invention.

In an embodiment of the present invention, the alkyl (meth)acrylate monomer preferably has a branched structure. This branched structure reduces the crystallization of the crystalline polyester resin component. Thus, the microdispersion of crystalline domains of the crystalline polyester resin component is maintained even during storage of the toner at a high temperature, resulting in satisfactory fixing properties.

In an embodiment of the present invention, the crystalline polyester resin component satisfies Formula (4) in view of achievement of the advantageous effects of the present invention.

In an embodiment of the present invention, the crystalline polyester resin component preferably includes a hybrid crystalline polyester resin component prepared through bonding of a crystalline polyester resin segment and an amorphous resin segment. This configuration can improve the affinity of the crystalline polyester resin component for the amorphous resin component contained in the binder resin. The improved affinity causes acceleration of the microdispersion of crystalline domains of the crystalline polyester resin component, resulting in an improvement in low-temperature fixing properties.

In an embodiment of the present invention, the binder resin preferably includes an amorphous polyester resin component. Incorporation of the amorphous polyester resin component improves adhesion between the toner and a paper sheet, resulting in a reduction in image distortion at a bent or scratched portion of the sheet.

In an embodiment of the present invention, the amorphous polyester resin component preferably includes a styrene-acrylic modified polyester resin in view of achievement of the advantageous effects of the present invention.

In an embodiment of the present invention, $R_2$ of Formula (1) is preferably an alkyl group having eight carbon atoms in view of achievement of the advantageous effects of the present invention.

In an embodiment of the present invention, the number of carbon atoms of the main chain of the structural unit derived from the polyhydric alcohol forming the crystalline polyester resin component (i.e., $C_{alcohol}$) is preferably 2 to 12 in view of achievement of the advantageous effects of the present invention.

In an embodiment of the present invention, the number of carbon atoms of the main chain of the structural unit derived from the polyvalent carboxylic acid forming the crystalline polyester resin component (i.e., $C_{acid}$) is preferably 6 to 16 in view of achievement of the advantageous effects of the present invention.

In an embodiment of the present invention, the toner particle preferably has a core-shell structure composed of a core particle coated with a shell layer in view of achievement of the advantageous effects of the present invention.

The present invention, components thereof, and embodiments and aspects for implementing the present invention will now be described in detail. As used herein, the term "to" between two numerical values indicates that the numeric values before and after the term are inclusive as the lower limit value and the upper limit value, respectively.

The toner for developing electrostatic images of the present invention will now be described.

<<Toner for Developing Electrostatic Images>>

The toner for developing electrostatic images of the present invention is composed of toner particles.

Each toner particle includes a binder resin and a release agent. The binder resin contains an amorphous resin component and a crystalline resin component. Each toner particle may optionally contain one or more internal additives, such as a colorant and a charge controlling agent, or one or more external additives, such as inorganic microparticles, organic microparticles, and a lubricant.

The toner particles according to the present invention have a volume average particle size of 3.0 to 8.0 μm, preferably 4.0 to 7.5 μm. The toner particles having such an average particle size are less likely to adhere to a heating unit during fixation, resulting in reduced fixing offset. The toner particles exhibit high transfer efficiency and contribute to an improvement in the quality of halftone images and line and dot images. The toner including the toner particles exhibits sufficient fluidity.

The average particle size of the toner particles can be adjusted by control of the concentration of a flocculant and/or the amount of a solvent added during the agglomeration and fusion process in production of the toner, the fusion time, and/or the composition of the binder resin.

In view of an improvement in transfer efficiency, the toner for developing electrostatic images of the present invention has an average roundness of preferably 0.920 to 1.000, more preferably 0.940 to 0.995, as determined by the following expression:

average roundness=(the perimeter of a circle having a diameter corresponding to that of a toner particle)/(the perimeter of the projected image of the toner particle).

The average roundness of the toner particles can be measured with, for example, a particle size and shape analyzer "FPIA-2100" (manufactured by Sysmex Corp.).

Materials of the toner for developing electrostatic images of the present invention will now be described in detail.

<<Binder Resin>>

The binder resin forming the toner particles according to the present invention contains a crystalline resin component and an amorphous resin component as detailed below.

<<Crystalline Resin Component>>

The crystalline resin component according to the present invention exhibits a clear endothermic peak, rather than a step-wise endothermic change, in differential scanning calorimetry (DSC) of the toner. The clear endothermic peak has a half width of 15° C. or lower as determined by DSC described in Examples at a heating rate of 10° C./min.

The toner contains the crystalline resin component in an amount of preferably 3 to 30 mass %. In this case, the binder resin exhibits stable sharp-melting properties, resulting in an improvement in low-temperature fixing properties of the toner. Incorporation of the crystalline resin component can maintain the heat resistance of the toner.

The crystalline resin component according to the present invention includes a crystalline polyester resin component. The crystalline polyester resin component has ester bonds that can readily adsorb moisture. Thus, the toner can readily release electric charge and more effectively prevent adhesion between sheets having thermally fixed toner images.

The crystalline polyester resin component will now be described in detail.

[Crystalline Polyester Resin Component]

The crystalline polyester resin component is derived from any known polyester resin prepared through polycondensation between a di- or more-valent carboxylic acid (polyvalent carboxylic acid) and a di- or more-valent alcohol (polyhydric alcohol). The crystalline polyester resin component exhibits a clear endothermic peak, rather than a step-wise endothermic change, by differential scanning calorimetry (DSC) of the toner. The clear endothermic peak has a half width of 15° C. or lower as determined by DSC described in Examples at a heating rate of 10° C./min.

The crystalline polyester resin component according to the present invention satisfies Formula (2):

$$5 \leq |C_{acid} - C_{alcohol}| \leq 12 \quad \text{Formula (2):}$$

where $C_{alcohol}$ represents the number of carbon atoms of the main chain of a structural unit derived from a polyhydric alcohol forming the crystalline polyester resin component and $C_{acid}$ represents the number of carbon atoms of the main chain of a structural unit derived from a polyvalent carboxylic acid forming the crystalline polyester resin component.

In the present invention, each toner particle includes a crystalline polyester resin component having alkyl chains of different lengths that are repeated via ester bonds. This configuration prevents aggregation of grains of the crystalline polyester resin component and thus formation of large crystal domains of the crystalline polyester resin component even in high-temperature environments. Thus, the toner maintains fixing properties even after being stored at high temperature.

From the viewpoint of effective achievement of similar advantageous effects, the crystalline polyester resin component preferably satisfies Formula (3):

$$6 \leq |C_{acid} - C_{alcohol}| \leq 10. \quad \text{Formula (3):}$$

From the viewpoint of effective achievement of the advantageous effects of the present invention, the crystalline polyester resin component satisfies Formula (4):

$$C_{alcohol} < C_{acid}. \quad \text{Formula (4):}$$

From the viewpoint of more effective achievement of the advantageous effects of the present invention, the number of carbon atoms of the main chain of the structural unit derived from the polyhydric alcohol forming the crystalline polyester resin component (i.e., $C_{alcohol}$) is preferably 2 to 12, and the number of carbon atoms of the main chain of the structural unit derived from the polyvalent carboxylic acid forming the crystalline polyester resin component (i.e., $C_{acid}$) is preferably 6 to 16.

The crystalline polyester resin component according to the present invention has a melting point (Tm) of preferably 50 to 90° C., more preferably 60 to 80° C., in view of sufficient low-temperature fixing properties and thermal resistance during storage of the toner.

The melting point (Tm) can be measured by DSC. In specific, a crystalline resin sample is sealed in an aluminum pan (KIT NO. B0143013) and is placed on a sample holder of a thermal analyzer Diamond DSC (manufactured by PerkinElmer Inc.). The temperature of the sample is controlled through sequential processes of heating, cooling, and heating. In each of the first and second heating processes, the sample is heated from room temperature (25° C.) to 150° C. at a rate of 10° C./min and maintained at 150° C. for five minutes. In the cooling process, the sample is cooled from 150° C. to 0° C. at a rate of 10° C./min and maintained at 0° C. for five minutes. The melting point (Tm) corresponds to the temperature at the top of the endothermic peak in an endothermic curve obtained through the second heating process.

The crystalline polyester resin component according to the present invention preferably has a weight average molecular weight (Mw) of 5,000 to 50,000 and a number average molecular weight (Mn) of 2,000 to 10,000 in view of the low-temperature fixing properties and gloss stability of the toner.

The crystalline polyester resin content of the toner particle is preferably 1 to 20 mass %, more preferably 5 to 15 mass %, in view of sufficient low-temperature fixing properties and thermal resistance during storage of the toner. If the crystalline polyester resin content falls within this preferred range, the aforementioned amorphous vinyl resin component can uniformly disperse the crystalline resin component in the toner particle, and thus prevent further crystallization of the crystalline resin component.

If the crystalline polyester resin component satisfies the aforementioned definitions, the crystalline polyester resin component may be derived from any crystalline polyester resin or may include a hybrid crystalline polyester resin component described below. The hybrid crystalline polyester resin component will now be described.

[Hybrid Crystalline Polyester Resin Component (Hybrid Resin Component)]

The hybrid crystalline polyester resin component (hereinafter may be referred to simply as "hybrid resin component") is a chemically bonded composite of a crystalline polyester resin segment and an amorphous resin segment other than the polyester resin.

The crystalline polyester resin segment is derived from any crystalline polyester resin. Thus, the crystalline polyester resin segment refers to a molecular chain having the same chemical structure as the crystalline polyester resin. The amorphous resin segment other than the polyester resin is derived from any amorphous resin other than the polyester resin. Thus, the amorphous resin segment refers to a molecular chain having the same chemical structure as the amorphous resin other than the polyester resin.

The hybrid resin component has a weight average molecular weight (Mw) of preferably 5,000 to 100,000, more preferably 7,000 to 50,000, particularly preferably 8,000 to 20,000, in view of compatibility between sufficient low-temperature fixing properties and superior long-term storage stability of the toner. A weight average molecular weight (Mw) of the hybrid resin component of 100,000 or less leads to sufficient low-temperature fixing properties of the toner. A weight average molecular weight (Mw) of the hybrid resin component of 5,000 or more precludes excessive compatibilization between the hybrid resin component and the amorphous resin component during storage of the toner, resulting in effective prevention of image defects caused by fused toner particles.

(Crystalline Polyester Resin Segment)

The crystalline polyester resin segment is derived from any known polyester resin prepared through polycondensation between a di- or more-valent carboxylic acid (polyvalent carboxylic acid) and a di- or more-valent alcohol (polyhydric alcohol). The crystalline polyester resin segment exhibits a clear endothermic peak, rather than a stepwise endothermic change, by differential scanning calorimetry (DSC) of the toner. The clear endothermic peak has a half width of 15° C. or lower as determined by DSC described in Examples at a heating rate of 10° C./min.

The crystalline polyester resin segment satisfying the aforementioned definitions may be in any form. For example, the following copolymer resins correspond to the hybrid resin component containing the crystalline polyester resin segment according to the present invention: a resin composed of a crystalline polyester resin segment having a main chain copolymerized with any other component and a resin composed of a crystalline polyester resin segment copolymerized with the main chain of any other component, with the proviso that the toner containing such a copolymer resin exhibits the aforementioned clear endothermic peak.

The crystalline polyester resin segment is composed of a polyvalent carboxylic acid component and a polyhydric alcohol component.

A dicarboxylic acid component is used as the polyvalent carboxylic acid component. The dicarboxylic acid component is preferably an aliphatic dicarboxylic acid, and may be used in combination with an aromatic dicarboxylic acid. The aliphatic dicarboxylic acid is preferably a linear-chain aliphatic dicarboxylic acid. The use of a linear-chain aliphatic dicarboxylic acid is advantageous in view of an improvement in crystallinity. Two or more dicarboxylic acid components may be used in combination.

Examples of the aliphatic dicarboxylic acid include oxalic acid, malonic acid, succinic acid, glutaric acid, adipic acid, pimelic acid, suberic acid, azelaic acid, sebacic acid, 1,9-nonanedicarboxylic acid, 1,10-decanedicarboxylic acid, 1,11-undecanedicarboxylic acid, 1,12-dodecanedicarboxylic acid (dodecanedioic acid), 1,13-tridecanedicarboxylic acid, 1,14-tetradecanedicarboxylic acid, 1,16-hexadecanedicarboxylic acid, and 1,18-octadecanedicarboxylic acid. Lower alkyl esters and anhydrides of these acids may also be used.

Among the aforementioned aliphatic dicarboxylic acids, preferred are aliphatic dicarboxylic acids having 6 to 16 carbon atoms in view of the advantageous effects of the present invention. More preferred are aliphatic dicarboxylic acids having 10 to 14 carbon atoms.

Examples of the aromatic dicarboxylic acid that can be used in combination with the aliphatic dicarboxylic acid include terephthalic acid, isophthalic acid, o-phthalic acid, t-butylisophthalic acid, 2,6-naphthalenedicarboxylic acid, and 4,4'-biphenyldicarboxylic acid. Among these acids, preferred are terephthalic acid, isophthalic acid, and t-butylisophthalic acid, which can be readily available and emulsified.

The dicarboxylic acid component of the crystalline polyester resin segment contains an aliphatic dicarboxylic acid in an amount of preferably 50 mol % or more, more preferably 70 mol % or more, still more preferably 80 mol % or more, particularly preferably 100 mol %. An aliphatic dicarboxylic acid content of the dicarboxylic acid component of 50 mol % or more leads to sufficient crystallinity of the crystalline polyester resin segment.

A diol component is used as the polyhydric alcohol component. The diol component is preferably an aliphatic diol. The diol component may optionally contain any diol other than an aliphatic diol. The aliphatic diol is preferably a linear-chain aliphatic diol. The use of a linear-chain aliphatic diol is advantageous in view of an improvement in crystallinity. Two or more diol components may be used in combination.

Examples of the aliphatic diol include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecandiol, and 1,20-eicosanediol.

Among the aforementioned aliphatic diols, preferred are aliphatic diols having 2 to 12 carbon atoms in view of the advantageous effects of the present invention. More preferred are aliphatic diols having four to six carbon atoms.

Examples of the optional diol other than the aliphatic diol include diols having a double bond and diols having a sulfonate group. Specific examples of the diols having a double bond include 2-butene-1,4-diol, 3-butene-1,6-diol, and 4-butene-1,8-diol.

The diol component of the crystalline polyester resin segment contains an aliphatic diol in an amount of preferably 50 mol % or more, more preferably 70 mol % or more, still more preferably 80 mol % or more, particularly preferably 100 mol %. An aliphatic diol content of the diol component of 50 mol % or more leads to sufficient crystallinity of the crystalline polyester resin segment, resulting in superior low-temperature fixing properties of the resultant toner, and glossy images provided by the toner.

The equivalent ratio of the hydroxy group [OH] of the diol component to the carboxy group [COOH] of the dicarboxylic acid component ([OH]/[COOH]) is preferably 2.0/1.0 to 1.0/2.0, more preferably 1.5/1.0 to 1.0/1.5, particularly preferably 1.3/1.0 to 1.0/1.3.

The crystalline polyester resin segment may be prepared through any known process. For example, the segment can be prepared through polycondensation (esterification) between the aforementioned polyvalent carboxylic acid and polyhydric alcohol in the presence of any known esterification catalyst.

Examples of the catalyst usable for the production of the crystalline polyester resin segment include compounds of alkali metals, such as sodium and lithium; compounds containing group 2 elements, such as magnesium and calcium; compounds of metals, such as aluminum, zinc, manganese, antimony, titanium, tin, zirconium, and germanium; phosphite compounds; phosphate compounds; and amine compounds. Specific examples of the tin compound include dibutyltin oxide, tin octylate, tin dioctylate, and salts thereof. Examples of the titanium compound include titanium alkoxides, such as tetra-n-butyl titanate, tetraisopropyl titanate, tetramethyl titanate, and tetrastearyl titanate; titanium acrylates, such as polyhydroxytitanium stearate; and titanium chelate compounds, such as titanium tetraacetylacetonate, titanium lactate, and titanium triethanolaminate. Examples of the germanium compound include germanium dioxide. Examples of the aluminum compounds include oxides, such as poly(aluminum hydroxide); aluminum alkoxides; and tributyl aluminate. These compounds may be used alone or in combination.

The polymerization may be performed at any temperature. The polymerization temperature is preferably 150 to 250° C. The polymerization may be performed for any period of time. The polymerization time is preferably 0.5 to 10 hours. The polymerization may optionally be performed in a reaction system under reduced pressure.

The content of the crystalline polyester resin segment is preferably 80 mass % or more and less than 98 mass %, more preferably 90 mass % or more and less than 95 mass %, still more preferably 91 mass % or more and less than 93 mass %, relative to the entire amount of the hybrid resin component. A content of the crystalline polyester resin segment within the above range leads to sufficient crystallinity of the hybrid resin component. The components contained in the respective segments in the hybrid resin component and their proportions can be determined by NMR or methylation pyrolysis-gas chromatography/mass spectrometry (P-GC/MS), for example.

The crystalline polyester resin segment is preferably prepared through polycondensation of the aforementioned polyvalent carboxylic acid and polyhydric alcohol and a compound that chemically bonds to the amorphous resin segment. As detailed below, the amorphous resin segment is preferably a vinyl resin segment, and a compound is preferred which bonds to the resin segment through addition polymerization. Thus, the crystalline polyester resin segment preferably contains a compound that can be polycondensed with the aforementioned polyvalent carboxylic acid and polyhydric alcohol and has an unsaturated bond (preferably a double bond).

Examples of the compound include polyvalent carboxylic acids having a double bond, such as methylenesuccinic acid, fumaric acid, maleic acid, 3-hexenedioic acid, and 3-octenedioic acid; and polyhydric alcohols having a double bond, such as 2-butene-1,4-diol, 3-butene-1,6-diol, and 4-butene-1,8-diol.

The content of the structural unit derived from the compound is preferably 0.5 to 20 mass % relative to the entire amount of the crystalline polyester resin segment.

The hybrid resin component contains the crystalline polyester resin segment and an amorphous resin segment other than the polyester resin, which will be detailed below. The hybrid resin component may be any block or graft copolymer composed of the crystalline polyester resin segment and the amorphous resin segment other than the polyester resin. The hybrid resin component is preferably a graft copolymer. The graft copolymer facilitates control of the orientation of the crystalline polyester resin segment, resulting in sufficient crystallinity of the hybrid resin component.

From the aforementioned viewpoints, the crystalline polyester resin segment is preferably grafted to the main chain of the amorphous resin segment other than the crystalline polyester resin. Thus, the hybrid crystalline polyester resin component is preferably a graft copolymer composed of the main chain of the amorphous resin segment other than the polyester resin and the side chain of the crystalline polyester resin segment.

Such a configuration can enhance the orientation of the crystalline polyester resin segment to improve the crystallinity of the hybrid resin component.

The hybrid resin component may have a substituent introduced thereinto, such as a sulfonate group, a carboxy group, or a urethane group. The substituent can be introduced into the crystalline polyester resin segment or into the amorphous resin segment other than the polyester resin, which will be detailed below.

(Amorphous Resin Segment Other Than Polyester Resin)

The amorphous resin segment other than the polyester resin (hereinafter may be referred to simply as "amorphous resin segment") is an essential segment for controlling the affinity between the amorphous resin component and hybrid resin component of the binder resin. The presence of the amorphous resin segment can improve the affinity between the hybrid resin component and the amorphous resin component to facilitate merging of the hybrid resin component into the amorphous resin component, resulting in improved charging uniformity.

The amorphous resin segment is derived from an amorphous resin other than the crystalline polyester resin. The amorphous resin segment contained in the hybrid resin component (and in the toner) can be confirmed through identification of the chemical structure by, for example, NMR or methylation P-GC/MS.

The results of differential scanning calorimetry (DSC) performed on a resin having the same chemical structure and molecular weight as those of the amorphous resin segment show that the resin has no melting point but has a relatively high glass transition temperature (Tg). In the DSC of the resin having the same chemical structure and same molecular weight as those of the amorphous resin segment, the glass transition temperature (Tg1) in the first heating process is preferably 30 to 80° C., particularly preferably 40 to 65° C. The glass transition temperature (Tg1) can be determined through the method described in Examples.

The amorphous resin segment satisfying the aforementioned definitions may be in any form. For example, the following copolymer resins correspond to the hybrid resin component containing the amorphous resin segment according to the present invention: a resin composed of an amorphous resin segment having a main chain copolymerized with any other component and a resin composed of an amorphous resin segment copolymerized with the main chain of any other component, with the proviso that the toner containing such a copolymer has the aforementioned amorphous resin segment.

The amorphous resin segment is preferably composed of a resin similar to the amorphous resin component contained in the binder resin (i.e., resin other than the crystalline resin). Such an amorphous resin segment significantly enhances the affinity between the hybrid resin component and the amorphous resin component. Thus, the hybrid resin component is more readily incorporated into the amorphous resin component, resulting in further improved charging uniformity.

As used herein, the term "similar resins" refers to resins having the same characteristic chemical bond in their repeating units. As used herein, the term "characteristic chemical bond" is defined according to "Polymer classification" of Materials Database of National Institute for Materials Science (NIMS) (http://polymer.nims.go.jp/PoLyInfo/guide/jp/term_polymer.html). The "characteristic chemical bonds" include chemical bonds in 22 polymers in total, i.e., polyacrylate, polyamide, polyacid anhydride, polycarbonate, polydiene, polyester, polyhaloolefin, polyimide, polyimine, polyketone, polyolefin, polyether, polyphenylene, polyphosphazene, polysiloxane, polystyrene, polysulfide, polysulfone, polyurethane, polyurea, polyvinyl, and miscellaneous.

The term "similar resins" in the case of the copolymeric resin refers to resins having the same characteristic chemical bond in their repeating units of monomer components in the copolymer. Thus, resins having the same characteristic chemical bond are regarded as similar resins, irrespective of the difference in characteristics of the resins or the molar proportion of the monomer components in the copolymer.

For example, a resin (or resin segment) composed of styrene, butyl acrylate, and acrylic acid and a resin (or resin segment) composed of styrene, butyl acrylate, and methacrylic acid have at least a chemical bond forming polyacrylate, and thus these resins are regarded as similar resins. In another example, a resin (or resin segment) composed of styrene, butyl acrylate, and acrylic acid and a resin (or resin segment) composed of styrene, butyl acrylate, acrylic acid, terephthalic acid, and fumaric acid have at least the same chemical bond forming polyacrylate. Thus, these resins are regarded as similar resins.

The amorphous resin segment may be composed of any resin component. Examples of the resin component include vinyl resins, urethane resins, and urea resins. Among these resins, preferred are vinyl resins in view of easy control of thermoplastic characteristics.

The vinyl resin may be of any type that is prepared through polymerization of a vinyl compound. Examples of the vinyl resin include acrylate resins, styrene-acrylate resins, and ethylene-vinyl acetate resins. These vinyl resins may be used alone or in combination.

Among these vinyl resins, preferred are styrene-acrylate resins (styrene-acrylic resins) in view of plasticity during thermal fixation. Thus, the styrene-acrylic resin segment serving as the amorphous resin segment will be described below.

The styrene-acrylic resin segment is prepared through addition polymerization of at least a styrene monomer and a (meth)acrylate monomer. As used herein, the "styrene monomer" includes styrene, which is represented by the formula $CH_2{=}CH{-}C_6H_5$, and styrene derivatives having known side chains or functional groups in the styrene structure. As used herein, the "(meth)acrylate monomer" includes acrylate and methacrylate compounds represented by the formula $CH_2{=}CHCOOR$ (where R is an alkyl group), and ester compounds having known side chains or functional groups in the structure of acrylate or methacrylate derivatives.

Non-limiting examples of the styrene monomers and the (meth)acrylate monomers that can form the styrene-acrylic resin segment used in the present invention are described below.

Examples of the styrene monomers include styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene, and p-n-dodecylstyrene. These styrene monomers may be used alone or in combination.

Specific examples of the (meth)acrylate monomers include acrylate monomers, such as methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate, and phenyl acrylate; and methacrylates, such as methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate, and dimethylaminoethyl methacrylate.

As used herein, the term "(meth)acrylate monomers" collectively refers to "acrylate monomers" and "methacrylate monomers." For example, "methyl (meth)acrylate" collectively refers to "methyl acrylate" and "methyl methacrylate."

These acrylate or methacrylate monomers may be used alone or in combination. In detail, the copolymer can be prepared from one styrene monomer in combination with two or more acrylate monomers, one styrene monomer in combination with two or more methacrylate monomers, or one styrene monomer in combination with one acrylate monomer and one methacrylate monomer.

The content of the structural unit derived from the styrene monomer is preferably 40 to 90 mass % relative to the entire amount of the amorphous resin segment. The content of the structural unit derived from the (meth)acrylate monomer is preferably 10 to 60 mass % relative to the entire amount of the amorphous resin segment. These structural units having contents within such ranges facilitate control of the plasticity of the hybrid resin component.

The amorphous resin segment is preferably prepared through addition polymerization of the styrene monomer, the (meth)acrylate monomer, and a compound that chemically bonds to the crystalline polyester resin segment. Particularly preferred is the use of a compound that forms an ester bond with the hydroxyl group [—OH] derived from the polyhydric alcohol or the carboxyl group [—COOH] derived from the polyvalent carboxylic acid contained in the crystalline polyester resin segment. Thus, the amorphous resin segment is preferably prepared through polymerization of the styrene monomer, the (meth)acrylate monomer, and a compound that can polymerize with the styrene monomer and the (meth)acrylate ester monomer and that has a carboxyl group [—COOH] or a hydroxyl group [—OH].

Examples of such a compound include compounds having a carboxyl group, such as acrylic acid, methacrylic acid, maleic acid, itaconic acid, cinnamic acid, fumaric acid, monoalkyl maleates, and monoalkyl itaconates; and compounds having a hydroxyl group, such as 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth)acrylate, 4-hydroxybutyl (meth)acrylate, and poly(ethylene glycol) mono(meth)acrylate.

The content of the structural unit derived from the aforementioned compound is preferably 0.5 to 20 mass % relative to the entire amount of the amorphous resin segment.

The styrene-acrylic resin segment can be prepared by any process; for example, polymerization of a monomer in the presence of any known oil- or water-soluble polymerization initiator. Specific examples of the oil-soluble polymerization initiator include azo or diazo polymerization initiators and peroxide polymerization initiators described below.

Examples of the azo or diazo polymerization initiators include 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile.

Examples of the peroxide polymerization initiators include benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxycyclohexyl) propane, and tris-(t-butylperoxy)triazine.

A water-soluble radical polymerization initiator can be used in preparation of resin particles by emulsion polymerization. Examples of the water-soluble polymerization initiator include persulfates, such as potassium persulfate and ammonium persulfate; azobisaminodipropane acetate; azobiscyanovaleric acid and salts thereof; and hydrogen peroxide.

The content of the amorphous resin segment is preferably 3 mass % or more and less than 15 mass %, more preferably 5 mass % or more and less than 10 mass %, still more preferably 7 mass % or more and less than 9 mass %, relative to the entire amount of the hybrid resin component. A content of the amorphous resin segment within the above range leads to sufficient crystallinity of the hybrid resin component.

(Preparation of Hybrid Crystalline Polyester Resin Component)

The hybrid resin component according to the present invention may be prepared by any process that can produce a polymer having a structure composed of the crystalline polyester resin segment and the amorphous resin segment molecularly bonded thereto. Specific examples of the process of preparing the hybrid resin component include the following processes (1) to (3):

(1) Process involving preliminary polymerization of an amorphous resin segment and polymerization of a crystalline polyester resin segment in the presence of the amorphous resin segment to prepare a hybrid resin component.

In process (1), monomers (preferably, a styrene monomer and a vinyl monomer, such as a (meth)acrylate monomer) are polymerized into an amorphous resin segment through addition reaction. A polyvalent carboxylic acid and a polyhydric alcohol are polymerized into a crystalline polyester resin segment in the presence of the amorphous resin segment. While the polyvalent carboxylic acid and the polyhydric alcohol are subjected to condensation reaction, the amorphous resin segment is bonded by addition reaction to the polyvalent carboxylic acid or the polyhydric alcohol, to prepare a hybrid resin component.

Process (1) preferably involves incorporation of a site enabling the reaction between the crystalline polyester resin segment and the amorphous resin segment into the crystalline polyester resin segment or the amorphous resin segment. In detail, process (1) prepares an amorphous resin segment with a compound having a site reactive with a carboxy group [—COOH] or a hydroxy group [—OH] remaining in the crystalline polyester resin segment and a site reactive with the amorphous resin unit besides the monomers forming the amorphous resin segment. This compound can react with the carboxy group [—COOH] or the hydroxyl group [—OH] in the crystalline polyester resin segment to chemically bond the crystalline polyester resin segment with the amorphous resin segment.

Alternatively, the crystalline polyester resin segment may be prepared with a compound having a site reactive with the polyhydric alcohol or the polyvalent carboxylic acid and reactive with the amorphous resin segment.

Process (1) can prepare a hybrid resin component having a structure (graft structure) composed of the crystalline polyester resin segment molecularly bonded to the amorphous resin segment.

(2) Process involving separate preparation of a crystalline polyester resin segment and an amorphous resin segment and bonding of these segments to prepare a hybrid resin component In process (2), a polyvalent carboxylic acid and a polyhydric alcohol are polymerized into a crystalline polyester resin segment through condensation reaction. Separately from the reaction system for preparing the crystalline polyester resin segment, an amorphous resin segment is prepared from the aforementioned monomers through addition polymerization. Process (2) preferably involves incorporation of a site enabling the reaction between the crystalline polyester resin segment and the amorphous resin segment. The incorporation of such a reactive site is described above, and thus the detailed description thereof is omitted.

The resultant crystalline polyester resin segment is then reacted with the amorphous resin segment to prepare a hybrid resin component having a structure composed of the crystalline polyester resin segment molecularly bonded to the amorphous resin segment.

In the absence of the aforementioned reactive site in the crystalline polyester resin segment and the amorphous resin segment, a system containing both the crystalline polyester resin segment and the amorphous resin segment may be prepared, and a compound having a site enabling bonding of the crystalline polyester resin segment to the amorphous resin segment may be fed into the system. In this case, a hybrid resin component can be prepared which has a structure composed of the crystalline polyester resin segment molecularly bonded to the amorphous resin segment.

(3) Process involving preliminary polymerization of a crystalline polyester resin segment and polymerization of an amorphous resin segment in the presence of the crystalline polyester resin segment to prepare a hybrid resin component.

In process (3), a polyvalent carboxylic acid and a polyhydric alcohol are polymerized into a crystalline polyester resin segment through condensation reaction. An amorphous resin segment is then prepared from monomers for the segment in the presence of the crystalline polyester resin segment. As in process (1), process (3) preferably involves incorporation of a site enabling the reaction between the crystalline polyester resin segment and the amorphous resin segment into the crystalline polyester resin segment or the amorphous resin segment. The incorporation of such a reactive site is described above, and thus the detailed description thereof is omitted.

Process (3) can prepare a hybrid resin component having a structure (grafted structure) composed of the amorphous resin segment molecularly bonded to the crystalline polyester resin segment.

Among processes (1) to (3), preferred is process (1), which can simplify production steps and can readily prepare a hybrid resin having a structure composed of the crystalline polyester resin chain grafted to the amorphous resin chain. In process (1), the amorphous resin segment is preliminarily prepared, and the crystalline polyester resin segment is then bonded to the amorphous resin segment. This process readily forms a crystalline polyester resin segment of uniform orientation, and thus can reliably prepare a hybrid resin component suitable for the toner of the present invention.

<<Amorphous Resin Component>>

The amorphous resin component of the binder resin according to the present invention includes a vinyl resin component. Preferably, the amorphous resin component further includes an amorphous polyester resin component, such as a styrene-acrylic modified polyester resin.

The amorphous resin component has no melting point but has a relatively high glass transition temperature (Tg) determined by differential scanning calorimetry (DSC). In the DSC of the amorphous resin component, the glass transition temperature (Tg1) in the first heating process is preferably 35 to 80° C., particularly preferably 45 to 65° C., and the glass transition temperature (Tg2) in the second heating process is preferably 20 to 70° C., particularly preferably 30 to 55° C. The glass transition temperatures (Tg1 and Tg2) can be determined through the method described in Examples.

The amorphous resin component preferably contains a resin component forming the segment described above in the section "(Amorphous resin segment other than polyester resin)."

The amorphous resin component is preferably composed of a resin similar to that for the amorphous resin segment of the hybrid resin component. The amorphous resin component composed of a "similar resin" may be a component composed only of the similar resin, or a component containing the similar resin and another amorphous resin. If the amorphous resin component is composed of a similar resin and another amorphous resin, the content of the similar resin is preferably 15 mass % or more, more preferably 20 mass % or more, relative to the entire amount of the amorphous resin component.

The amorphous resin component may be a copolymer having a segment derived from a resin similar to that for the amorphous resin segment of the hybrid resin component and a segment derived from another amorphous resin. The amorphous resin component may be a block copolymer or a graft copolymer, but is preferably a graft copolymer in view of easy control of the compatibility between the amorphous resin component and the hybrid resin component. In this case, the content of the segment derived from the resin similar to that for the amorphous resin segment of the hybrid resin component is preferably 15 mass % or more, more preferably 20 mass % or more, relative to the entire amount of the amorphous resin component.

The term "similar resins" is defined above in the section "(Amorphous resin segment other than polyester resin)," and thus the detailed description thereof is omitted.

The amorphous resin component preferably contains a vinyl resin and a styrene-acrylic modified polyester resin. This configuration contributes to easy control of the compatibility between the amorphous resin component and the hybrid resin component particularly when the amorphous resin segment of the hybrid resin component is a vinyl resin segment.

The vinyl resin component and the amorphous polyester resin component according to the present invention will now be described in detail.

[Vinyl Resin Component]

The vinyl resin component contained in the amorphous resin component according to the present invention has a structural unit derived from an alkyl (meth)acrylate monomer represented by Formula (1):

$$H_2C{=}CR_1{-}COOR_2 \qquad \text{Formula (1):}$$

where $R_1$ represents a hydrogen atom or a methyl group, and $R_2$ represents an alkyl group having 8 to 22 carbon atoms. An alkyl group having 8 or more carbon atoms leads to appropriate affinity between the vinyl resin component and the crystalline polyester resin component according to the present invention. An alkyl group having 22 or less carbon atoms leads to a glass transition temperature of the binder resin within the aforementioned preferred range, resulting in superior low-temperature fixing properties.

In view of achievement of the aforementioned advantageous effects, the content of the vinyl resin component is preferably 50 to 95 mass %, more preferably 70 to 85 mass %, relative to the entire amount of the binder resin.

The alkyl (meth)acrylate monomer represented by Formula (1) preferably has a branched structure. Incorporation of the compound having such a branched structure into the linear-chain crystalline polyester resin component according to the present invention probably reduces further crystallization of the crystalline polyester resin component. Thus, the microdispersion of crystalline domains of the crystalline polyester resin component is maintained even during storage of the toner at high temperature, resulting in satisfactory fixing properties.

Examples of the alkyl (meth)acrylate monomer include acrylate monomers having a branched structure, such as isooctyl acrylate, 2-ethylhexyl acrylate, 1-methylheptyl acrylate, 2-propylheptyl acrylate, 6-methylheptyl acrylate, isononyl acrylate, isodecyl acrylate, tridecyl acrylate, and isostearyl acrylate; acrylate monomers having no branched structure, such as n-octyl acrylate, lauryl acrylate, cetyl acrylate, stearyl acrylate, and behenyl acrylate; methacrylate monomers having a branched structure, such as isooctyl methacrylate, 2-ethylhexyl methacrylate, and tridecyl methacrylate; and methacrylate monomers having no branched structure, such as n-octyl methacrylate, lauryl methacrylate, cetyl methacrylate, stearyl methacrylate, and behenyl methacrylate. Among these monomers, n-octyl acrylate is particularly preferred.

The vinyl resin component may be any resin prepared through polymerization of a vinyl compound having a structural unit derived from the aforementioned alkyl (meth) acrylate monomer. Examples of the resin include acrylate resins and styrene-acrylate resins. These resins may be used alone or in combination.

The vinyl resin component is preferably a styrene-acrylate resin (styrene-acrylic resin) in view of plasticity during thermal fixation. Monomers for the styrene-acrylic resin may be the same as those for the styrene-acrylic resin segment described above in the section "(Amorphous resin segment other than polyester resin)."

Preferred examples of the styrene monomer include styrene, o-methylstyrene, m-methylstyrene, p-methylstyrene, α-methylstyrene, p-phenylstyrene, and p-ethylstyrene. Preferred examples of the (meth)acrylate monomer include acrylate monomers, such as methyl acrylate, ethyl acrylate, isopropyl acrylate, n-butyl acrylate, and isobutyl acrylate; and methacrylate monomers, such as methyl methacrylate, ethyl methacrylate, n-butyl methacrylate, isopropyl methacrylate, and isobutyl methacrylate. These styrene monomers or (meth)acrylate monomers may be used alone or in combination.

The vinyl resin component may contain a polymer of an additional monomer. Examples of the additional monomer include acrylic acid, methacrylic acid, maleic acid, itaconic acid, cinnamic acid, fumaric acid, monoalkyl maleate, monoalkyl itaconate, 2-hydroxyethyl (meth)acrylate, 2-hydroxypropyl (meth)acrylate, 3-hydroxypropyl (meth)acrylate, 2-hydroxybutyl (meth)acrylate, 3-hydroxybutyl (meth) acrylate, 4-hydroxybutyl (meth)acrylate, and poly(ethylene glycol) mono(meth)acrylate.

The content of the structural unit derived from the styrene monomer in the styrene-acrylic resin is preferably 40 to 90 mass % relative to the entire amount of the styrene-acrylic resin. The content of the structural unit derived from the (meth)acrylate monomer in the styrene-acrylic resin is preferably 10 to 60 mass % relative to the entire amount of the styrene-acrylic resin. Such a content of the structural unit leads to easy control of the plasticity of the amorphous resin component.

The content of the structural unit derived from the aforementioned additional monomer in the styrene-acrylic resin is preferably 0.5 to 30 mass % relative to the entire amount of the styrene-acrylic resin.

The styrene-acrylic resin may be prepared by any known process. For example, the styrene-acrylic resin can be prepared as in the styrene-acrylic resin segment described above in the section "(Amorphous resin segment other than polyester resin)."

The amorphous vinyl resin component preferably has a weight average molecular weight (Mw) of 20,000 to 150,000 and a number average molecular weight (Mn) of 5,000 to 20,000 in view of compatibility between fixing properties and hot offset resistance of the toner.

The weight average molecular weight (Mw) and the number average molecular weight (Mn) can be calculated on the basis of the molecular weight distribution determined by gel permeation chromatography (GPC).

A sample is added to tetrahydrofuran (THF) (concentration: 1 mg/mL) and dispersed therein with an ultrasonic disperser at room temperature for five minutes. The dispersion is then filtered through a membrane filter having a pore size of 0.2 μm to prepare a sample solution. The GPC analysis involves the use of a GPC apparatus HLC-8120 GPC (manufactured by Tosoh Corporation) provided with a TSKguard column and three TSKgelSuperHZ-m columns (manufactured by Tosoh Corporation). While the column is maintained at 40° C., the column is fed with tetrahydrofuran (carrier solvent) at a flow rate of 0.2 mL/min. The sample solution (10 μL) and the carrier solvent are injected into the GPC apparatus, and the sample is detected with a refractive index detector (RI detector). The molecular weight distribution of the sample is then calculated from a calibration curve prepared with monodisperse polystyrene standard particles. The calibration curve is prepared with ten polystyrene samples.

The amorphous vinyl resin component has a glass transition temperature (Tg) of preferably 20 to 70° C. in view of compatibility between fixing properties and thermal resistance during storage of the toner.

The glass transition temperature (Tg) can be determined in accordance with the method (DSC method) specified in American Society for Testing and Materials (ASTM) standard D3418-82. The glass transition temperature (Tg) can be determined with, for example, a differential scanning calorimeter DSC-7 (manufactured by PerkinElmer Inc.) or a thermal analysis controller TAC7/DX (manufactured by PerkinElmer Inc.).

[Amorphous Polyester Resin Component]

The binder resin preferably contains an amorphous polyester resin component in addition to the vinyl resin component. Incorporation of the amorphous polyester resin component improves adhesion between the toner and a paper sheet, resulting in a reduction in image distortion at a bent or scratched portion of the sheet.

The content of the amorphous polyester resin component is preferably 1 to 50% relative to the entire amount of the amorphous resin component in view of achievement of the aforementioned advantageous effects.

The amorphous polyester resin component is preferably an amorphous styrene-acrylic modified polyester resin. As used herein, "styrene-acrylic modified polyester resin" refers to a resin having a polyester molecular structure including an amorphous polyester chain (hereinafter may be referred to as "polyester segment") molecularly bonded to a styrene-acrylic copolymer chain (hereinafter may be referred to as "styrene-acrylic copolymer segment"). Thus, the styrene-acrylic modified polyester resin has a copolymeric structure including the polyester segment covalently bonded to the styrene-acrylic copolymer segment.

The styrene-acrylic modified polyester resin serving as the amorphous polyester resin component is clearly distinguished from the aforementioned hybrid resin component as described below. Unlike the crystalline polyester resin segment of the hybrid resin component, the polyester segment of the amorphous styrene-acrylic modified polyester resin is an amorphous molecular chain having no clear melting point and a relatively high glass transition temperature (Tg). These properties can be confirmed through differential scanning calorimetry (DSC) of the toner. The monomer for the polyester segment has a chemical structure different from that of the monomer for the crystalline polyester resin segment, and thus these monomers can be distinguished from each other by NMR analysis, for example.

The polyester segment is composed of a polyhydric alcohol component and a polyvalent carboxylic acid component.

Any polyhydric alcohol component can be used. The polyhydric alcohol component is preferably an aromatic diol or a derivative thereof in view of the charging properties and strength of the toner. Examples of the aromatic diol or the derivative include bisphenols, such as bisphenol A and bisphenol F; and alkylene oxide adducts of bisphenols, such as ethylene oxide adducts and propylene oxide adducts of bisphenols.

Among these polyhydric alcohol components, preferred are ethylene oxide adducts and propylene oxide adducts of bisphenol A in view of an improvement in uniform charging. These polyhydric alcohol components may be used alone or in combination.

Examples of the polyvalent carboxylic acid component condensed with the polyhydric alcohol component include aromatic carboxylic acids, such as terephthalic acid, isophthalic acid, phthalic anhydride, trimellitic anhydride, pyromellitic acid, and naphthalenedicarboxylic acid; aliphatic carboxylic acids, such as fumaric acid, maleic anhydride, and alkenylsuccinic acid; and lower alkyl esters and anhydrides of these acids. These polyvalent carboxylic acid components may be used alone or in combination.

The polyester segment may be prepared by any process. For example, the polyester segment can be prepared as in the crystalline polyester resin segment described above in the section "(Crystalline polyester resin segment)."

The styrene-acrylic copolymer segment is a molecular chain derived from a monomer similar to that for the styrene-acrylic resin segment described above in the section "(Amorphous resin segment other than polyester resin)". Thus, the type and proportion of a monomer for the segment and the process of preparing the segment composition are not described below.

The content of the polyester segment is preferably 40 to 90 mass % relative the entire amount of the styrene-acrylic modified polyester resin. The content of the styrene-acrylic copolymer segment is preferably 10 to 60 mass % relative to the entire amount of the styrene-acrylic modified polyester resin. Such a content of each of these segments facilitates control of the plasticity of the styrene-acrylic modified polyester resin.

The amorphous polyester resin component preferably has a number average molecular weight (Mn) of 2,000 to 10,000 in view of easy control of the plasticity of the component.

The amorphous polyester resin component preferably has a glass transition point (Tg) of 20 to 70° C. The glass transition point (Tg) can be determined as in the amorphous vinyl resin component.

[Form of Binder Resin]

The binder resin contained in the toner of the present invention may be in any particulate form, so long as the binder resin contains the amorphous resin component.

Particles of the binder resin may have a single-layer structure or a core-shell structure (composed of a particulate resin core fused with a resin for a shell layer). A resin particle having a core-shell structure is composed of a particulate resin core containing a colorant or a wax and having a relatively low glass transition temperature, and a shell layer disposed on the resin core and having a relatively high glass transition temperature.

In the core-shell structure, the core particle may be completely coated with the shell layer, or may be incompletely coated with the shell layer and partially exposed to the outside.

A cross section of the core-shell structure can be observed with any known device, such as a transmission electron microscope (TEM) or a scanning probe microscope (SPM).

The content of the core resin is 30 to 95 mass % relative to the total amount (100 mass %) of the resins of the core and the shell layer.

<<Colorant>>

The colorant according to the present invention may be of any type, such as carbon black, a magnetic material, a dye, or a pigment. Examples of the carbon black include channel black, furnace black, acetylene black, thermal black, and lamp black. Examples of the magnetic material include ferromagnetic metals, such as iron, nickel, and cobalt; alloys of these metals; ferromagnetic metal compounds, such as ferrite and magnetite; alloys containing no ferromagnetic metal and exhibiting ferromagnetism through thermal treatment, such as Heusler alloys (e.g., manganese-copper-aluminum and manganese-copper-tin); and chromium dioxide.

Examples of the black colorant include carbon black materials, such as furnace black, channel black, acetylene black, thermal black, and lamp black; and powdery magnetic materials, such as magnetite and ferrite.

Examples of the magenta or red colorant include C. I. Pigment Reds 2, 3, 5, 6, 7, 15, 16, 48:1, 53:1, 57:1, 60, 63, 64, 68, 81, 83, 87, 88, 89, 90, 112, 114, 122, 123, 139, 144, 149, 150, 163, 166, 170, 177, 178, 184, 202, 206, 207, 209, 222, 238, and 269.

Examples of the orange or yellow colorant include C. I. Pigment Oranges 31 and 43, and C. I. Pigment Yellows 12, 14, 15, 17, 74, 83, 93, 94, 138, 155, 162, 180, and 185.

Examples of the green or cyan colorant include C. I. Pigment Blues 2, 3, 15, 15:2, 15:3, 15:4, 16, 17, 60, 62, and 66, and C. I. Pigment Green 7.

These colorants may be used alone or in combination.

The content of the colorant is preferably 1 to 30 mass %, more preferably 2 to 20 mass %, relative to the entire amount of the toner. The toner may contain any mixture of the aforementioned colorants. A content of the colorant within such a range leads to satisfactory color reproduction of images.

The colorant has a volume average particle size of 10 to 1,000 nm, preferably 50 to 500 nm, more preferably 80 to 300 nm.

<<Release Agent (Wax)>>

The toner may contain any known release agent. Specific examples of the release agent include polyolefin waxes, such as polyethylene wax and polypropylene wax; branched-chain hydrocarbon waxes, such as microcrystalline wax; long-chain hydrocarbon waxes, such as paraffin wax and Sasolwax; dialkyl ketone waxes, such as distearyl ketone; ester waxes, such as carnauba wax, montan wax, behenyl behenate, trimethylolpropane behenate, pentaerythritol tetrabehenate, pentaerythritol diacetate dibehenate, glycerol tribehenate, 1,18-octadecanediol distearate, tristearyl trimellitate, and distearyl maleate; and amide waxes, such as ethylenediaminebehenylamide and trimellitic acid tristearyl amide.

The release agent has a melting point of preferably 40 to 160° C., more preferably 50 to 120° C. A melting point of the release agent within the above range leads to sufficient thermal resistance during storage of the toner. In addition, toner images can be reliably formed during fixation at a low temperature without causing cold offset. The release agent content of the toner is preferably 1 to 30 mass %, more preferably 5 to 20 mass %.

<<Additional Component>>

The toner of the present invention may optionally contain an internal additive (e.g., a charge controlling agent) or an external additive (e.g., inorganic microparticles, organic microparticles, or a lubricant) in addition to the aforementioned components.

(Charge Controlling Agent)

The charge controlling agent may be any known compound. Examples of such a compound include nigrosine dyes, metal salts of naphthenic acid and higher fatty acids, alkoxylated amines, quaternary ammonium salts, azo-metal complexes, and salicylic acid metal salts.

The content of the charge controlling agent is typically 0.1 to 10 mass %, preferably 0.5 to 5 mass %, relative to the entire amount (100 mass %) of the binder resin contained in the resultant toner particles.

The charge controlling agent has a number average primary particle size of, for example, 10 to 1,000 nm, preferably 50 to 500 nm, more preferably 80 to 300 nm.

(External Additive)

The toner may contain any known external additive. Examples of the additive include inorganic microparticles, organic microparticles, and lubricants, in view of improvements in charging properties, fluidity, and cleanability. Such an external additive may be added to the surfaces of the toner particles.

The inorganic microparticles are preferably composed of, for example, silica, titania, alumina, or strontium titanate.

The inorganic microparticles may optionally be subjected to hydrophobic treatment.

The organic microparticles may be spherical organic microparticles having a number average primary particle size of about 10 to 2,000 nm. In detail, the organic microparticles may be composed of a homopolymer of styrene or methyl methacrylate or a copolymer of these monomers.

The lubricant is used for further improving the cleanability and transfer efficiency of the toner. Examples of the lubricant include metal salts of higher fatty acids, such as zinc, aluminum, copper, magnesium, and calcium salts of stearic acid, zinc, manganese, iron, copper, and magnesium salts of oleic acid, zinc, copper, magnesium, and calcium salts of palmitic acid, zinc and calcium salts of linoleic acid, and zinc and calcium salts of ricinoleic acid. These external additives may be used in combination.

The content of the external additive is preferably 0.1 to 10.0 mass % relative to the entire amount (100 mass %) of the toner particles.

The external additive may be compounded with any known mixer, such as a Turbula mixer, a Henschel mixer, a Nauta mixer, or a V-type mixer.

<<Production of Toner for Developing Electrostatic Images of the Present Invention>>

The toner for developing electrostatic images of the present invention can be produced by a wet process in an aqueous medium (e.g., emulsion aggregation). An exemplary process for producing the toner will now be described, but the toner may be produced by any other process.

The toner for developing electrostatic images of the present invention includes a binder resin and a release agent. The process for producing the toner includes the following first to fifth steps. The first step involves mixing of a dispersion of amorphous resin microparticles with a dispersion of colorant microparticles in an aqueous medium. The second step involves addition of a flocculant to the mixture prepared in the first step. The third step involves heating of the mixture prepared in the second step. The fourth step involves addition of a dispersion of crystalline resin microparticles before completion of the heating in the third step. The fifth step involves formation of aggregated particles through fusion of the amorphous resin microparticles, the crystalline resin microparticles, and the colorant microparticles.

The amorphous resin microparticles and the crystalline resin microparticles may be prepared by any process, such as emulsion polymerization, miniemulsion polymerization, or phase inversion emulsification, or any combination of these processes. Incorporation of an internal additive (e.g., a release agent) into the amorphous resin microparticles preferably involves the use of the miniemulsion polymerization process.

For incorporation of an internal additive (e.g., a release agent) into the toner particles, the internal additive may be incorporated in the amorphous resin microparticles as described above. Alternatively, a dispersion of internal additive microparticles may be separately prepared, and the dispersion may be added in the first step or may be added after addition of the flocculant in the second step and before addition of the crystalline resin microparticle dispersion in the fourth step.

The toner particles having a core-shell structure may be prepared through a step of forming a shell layer on each of the aggregated particles prepared in the fifth step. In detail, core particles are prepared through aggregation (or fusion) of the amorphous resin microparticles, the crystalline resin microparticles, and the colorant. Amorphous resin microparticles for a shell layer are then added to a dispersion of the core particles, and the surfaces of the core particles are coated with the amorphous resin microparticles through fusion, to form a shell layer.

Now will be described the first to fifth steps and optional steps (e.g., a shell-forming step) of the process for producing the toner for developing electrostatic images of the present invention.

(a) First Step

The first step involves mixing of a dispersion of amorphous resin microparticles with a dispersion of colorant microparticles in an aqueous medium. If the amorphous resin microparticles do not contain a release agent, the first step preferably involves mixing of a dispersion of release agent microparticles for incorporation of the release agent into the toner particles.

The amorphous resin microparticle dispersion, the colorant microparticle dispersion, and the release agent microparticle dispersion are prepared as described below.

(Preparation of Amorphous Resin Microparticle Dispersion)

The amorphous resin microparticle dispersion is prepared through synthesis of an amorphous resin for the toner particles and then dispersion of the amorphous resin in the form of microparticles in an aqueous medium.

The amorphous resin can be prepared as in the aforementioned process, and thus the redundant description is omitted.

The amorphous resin is dispersed in an aqueous medium by, for example, process (I) or (II) described below. Process (I) involves formation of amorphous resin microparticles from a monomer for the amorphous resin, and preparation of an aqueous dispersion of the amorphous resin microparticles. Process (II) involves dissolution or dispersion of the amorphous resin in an organic solvent to prepare an oil-phase solution, dispersion of the oil-phase solution in an aqueous medium through phase inversion emulsification to form oil droplets having a desired size, and removal of the organic solvent.

As used herein, the term "aqueous medium" refers to a medium containing water in an amount of 50 mass % or more. Examples of the component of the aqueous medium other than water include organic solvents miscible with water, such as methanol, ethanol, 2-propanol, butanol, acetone, methyl ethyl ketone, dimethylformamide, methyl cellosolve, and tetrahydrofuran. Among these compounds, preferred are organic alcohol solvents, such as methanol, ethanol, 2-propanol, and butanol, which cannot dissolve the resin. The aqueous medium preferably consists of only water.

Process (I) preferably involves addition of a monomer for the amorphous resin to an aqueous medium together with a polymerization initiator to prepare base particles through polymerization, and then addition of a radically polymerizable monomer for the amorphous resin and a polymerization initiator to a dispersion of the base particles for seed polymerization of the monomer with the base particles.

The polymerization initiator may be a water-soluble polymerization initiator. Preferred examples of the water-soluble polymerization initiator include water-soluble radical initiators, such as potassium persulfate and ammonium persulfate.

The seed polymerization system for preparation of the amorphous resin microparticles may use a common chain transfer agent for controlling the molecular weight of the amorphous resin. Examples of the chain transfer agent include mercaptans, such as octyl mercaptan, dodecyl mercaptan, and t-dodecyl mercaptan; mercaptopropionates, such as n-octyl 3-mercaptopropionate and stearyl 3-mercaptopropionate; and styrene dimers. These chain transfer agents may be used alone or in combination.

Process (II) preferably involves the use of an organic solvent having a low boiling point and low solubility in water for preparation of the oil-phase solution in view of easy removal of the solvent after formation of oil droplets. Specific examples of the methyl acetate, ethyl acetate, methyl ethyl ketone, isopropyl alcohol, methyl isobutyl ketone, toluene, and xylene. These organic solvents may be used alone or in combination.

The amount of an organic solvent (or the total amount of two or more organic solvents) is typically 10 to 500 parts by mass, preferably 100 to 450 parts by mass, more preferably 200 to 400 parts by mass, relative to 100 parts by mass of the amorphous resin.

The amount of the aqueous medium is preferably 50 to 2,000 parts by mass, more preferably 100 to 1,000 parts by mass, relative to 100 parts by mass of the oil-phase solution. An amount within in the above range leads to formation of oil droplets having a desired size through effective emulsification and dispersion of the oil-phase solution in the aqueous medium.

The aqueous medium may contain a dispersion stabilizer. Alternatively, the aqueous medium may contain a surfactant or a microparticulate resin for improving the dispersion stability of oil droplets.

The dispersion stabilizer may be of any known type. The dispersion stabilizer is preferably of an acid- or alkali-soluble type, such as tricalcium phosphate, or an enzyme-degradable type from the environmental viewpoint.

Examples of the surfactant include known anionic surfactants, cationic surfactants, nonionic surfactants, and amphoteric surfactants.

Examples of the microparticulate resin for improving the dispersion stability include microparticulate poly (methyl methacrylate) resins, microparticulate polystyrene resins, and microparticulate poly(styrene-acrylonitrile) resins.

The oil-phase solution can be emulsified by use of mechanical energy with any disperser. Examples of the disperser include homogenizers, low-rate shearing dispersers, high-rate shearing dispersers, frictional dispersers, high-pressure jet dispersers, and ultrasonic dispersers, and high-pressure impact dispersers (e.g., Ultimizer).

After the formation of the oil droplets, the entire dispersion of the amorphous resin microparticles in the aqueous medium is gradually heated under agitation and then maintained at a predetermined temperature under vigorous agitation, followed by removal of the organic solvent. The organic solvent may be removed with, for example, an evaporator under reduced pressure.

The amorphous resin microparticles (oil droplets) in the amorphous resin microparticle dispersion prepared by process (I) or (II) have a volume median particle size of preferably 60 to 1,000 nm, more preferably 80 to 500 nm. The volume median particle size is determined by the method described in Examples. The volume median particle size of the oil droplets can be adjusted by, for example, control of the mechanical energy during emulsification and dispersion.

The content of the amorphous resin microparticles in the amorphous resin microparticle dispersion is preferably 5 to 50 mass %, more preferably 10 to 30 mass %. A content of the amorphous resin microparticles within the above range leads to a narrow particles size distribution and an improvement in properties of the toner.

(Preparation of Colorant Microparticle Dispersion)

The colorant microparticle dispersion is prepared through dispersion of a colorant in the form of microparticles in an aqueous medium.

The aqueous medium is as described above in the section "(Preparation of amorphous resin microparticle dispersion)". The aqueous medium may contain a surfactant or resin microparticles for improving the dispersion stability of the colorant.

The colorant can be dispersed in the aqueous medium by mechanical energy in any disperser. The disperser may be the same as described above in the section "(Preparation of amorphous resin microparticle dispersion)".

The content of the colorant microparticles in the colorant microparticle dispersion is preferably 10 to 50 mass %, more preferably 15 to 40 mass %. A content of the colorant microparticles within the above range leads to satisfactory color reproduction of images.

(Preparation of Release Agent Microparticle Dispersion)

The release agent microparticle dispersion is prepared through dispersion of a release agent in the form of microparticles in an aqueous medium.

The aqueous medium is as described above in the section "(Preparation of amorphous resin microparticle dispersion)". The aqueous medium may contain a surfactant or resin microparticles for improving the dispersion stability of the release agent.

The release agent can be dispersed in the aqueous medium by mechanical energy with any disperser. The disperser may be the same as described above in the section "(Preparation of amorphous resin microparticle dispersion)".

The content of the release agent microparticles in the release agent microparticle dispersion is preferably 10 to 50 mass %, more preferably 15 to 40 mass %. A content within the above range leads to satisfactory hot offset resistance and releasability of the toner.

(b) Second Step

The second step involves addition of a flocculant to the mixture prepared in the first step.

The flocculant used in this step may be of any type, and is preferably selected from metal salts. Examples of the metal salts include salts of monovalent metals, such as alkali metals (e.g., sodium, potassium, and lithium); and salts of divalent metals (e.g., calcium, magnesium, manganese, and copper); and salts of trivalent metals (e.g., iron and aluminum). Specific examples of the metal salts include sodium chloride, potassium chloride, lithium chloride, calcium chloride, magnesium chloride, zinc chloride, copper sulfate, magnesium sulfate, and manganese sulfate. Among these, divalent metal salts are particularly preferred. The use of a small amount of such a divalent metal salt can promote aggregation. These flocculants may be used alone or in combination.

After addition of the flocculant in the second step, the resultant mixture is preferably allowed to stand for only a short period of time until the start of heating. Thus, the third step is preferably initiated immediately after addition of the flocculant in the second step, and the mixture is heated to a temperature higher than the melting point of the crystalline resin and the glass transition temperature of the amorphous resin. If the mixture is allowed to stand for a long period of time before the heating, resin particles may fail to be uniformly aggregated, leading to a variation in particle size distribution of the toner particles, and inconsistent surface properties of the toner particles. The mixture is allowed to stand before the heating for 30 minutes or less, preferably 10 minutes or less. The flocculant may be added at any temperature, but is preferably added at a temperature lower than the melting point of the crystalline resin and the glass transition temperature of the amorphous resin.

(c) Third Step

The third step involves heating of the mixture prepared in the second step.

As described above, the third step is preferably carried out immediately after the addition of the flocculant in the second step. The heating rate in the third step is preferably 0.8° C./min or more. The upper limit of the heating rate may be any value, and is preferably 15° C./min for avoiding formation of coarse particles due to rapid fusion. The mixture prepared in the second step is heated to a temperature equal to or higher than the glass transition temperature, and preferably at a temperature within a range of (the melting point of the crystalline resin−10° C.) to (the melting point+10° C.). This heating promotes aggregation of the amorphous resin microparticles and the colorant microparticles, to form aggregated particles.

If the amorphous resin microparticles do not contain a release agent, the aforementioned release agent microparticle dispersion is preferably added to the mixture after the addition of the flocculant in the second step and before addition of the amorphous resin microparticle dispersion in the fourth step, to incorporate the release agent into the toner particles.

(d) Fourth Step

The fourth step involves addition of a dispersion of microparticles of at least one crystalline resin before the completion of the heating in the third step.

In the addition of the crystalline resin microparticle dispersion in the fourth step, the aggregated particles contained in the mixture prepared in the third step preferably have a volume median particle size of 0.2 to 2.5 μm.

After initiation of the heating in the third step, aggregation of the amorphous resin microparticles and the colorant microparticles proceeds in the aqueous medium, and the particle size of the aggregated particles gradually increases. Addition of the crystalline resin microparticles to the aggregated particles having an appropriate particle size (i.e., 0.2 to 2.5 μm as described above) leads to formation of a toner having superior low-temperature fixing properties, charging characteristics, coloring characteristics, and thermal resistance during storage. Addition of the crystalline resin microparticles to the aggregated particles having a particle size of 2.5 μm or less prevents aggregation of the microparticles around the aggregated particles having a relatively large particle size, resulting in superior charging characteristics and thermal resistance during storage of the toner. Addition of the crystalline resin microparticles to the aggregated particles having a particle size of 0.2 μm or more prevents the microparticles from inhibiting the aggregation between the amorphous resin microparticles and the colorant microparticles, resulting in superior charging characteristics of the toner.

The volume median particle size of the aggregated particles can be determined with an analyzer UPA-150 (manufactured by Microtrac Inc.).

In the addition of the crystalline resin microparticle dispersion in the fourth step, the temperature of the mixture prepared in the third step preferably falls within a range of (the melting point of the crystalline resin microparticles−40° C.) to (the melting point+10° C.), more preferably (the melting point−20° C.) to (the melting point+5° C.)

In the addition of the crystalline resin microparticle dispersion in the fourth step, the temperature of the mixture prepared in the third step preferably falls within a range between the glass transition temperature of the amorphous resin and the melting point of the crystalline resin.

The crystalline resin microparticle dispersion is prepared as described below.

(Preparation of Crystalline Resin Microparticle Dispersion)

Now will be described the preparation of a dispersion of hybrid crystalline polyester resin microparticles (i.e., crystalline resin microparticle dispersion).

The dispersion of hybrid crystalline polyester resin (hybrid resin) microparticles is prepared through synthesis of a hybrid resin and then dispersion of the hybrid resin in the form of microparticles in an aqueous medium.

The hybrid resin can be prepared as in the aforementioned process, and thus the redundant description is omitted. The hybrid resin preferably contains the crystalline polyester resin segment and the amorphous resin segment in the aforementioned amounts. The hybrid resin according to the present invention satisfies Formula (2): $5 \leq |C_{acid} - C_{alcohol}| \leq 12$ where $C_{alcohol}$ represents the number of carbon atoms of a polyhydric alcohol forming the crystalline polyester resin segment and $C_{acid}$ represents the number of carbon atoms of a polyvalent carboxylic acid forming the crystalline polyester resin segment.

The hybrid resin microparticle dispersion is prepared through, for example, a process involving dispersion treatment of the hybrid resin in an aqueous medium without use of an organic solvent, or a process involving dissolution of the hybrid resin in an organic solvent (e.g., ethyl acetate), emulsification and dispersion of the solution in an aqueous medium with a disperser, and then removal of the solvent.

The crystalline polyester resin segment of the hybrid resin may contain a carboxy group. In such a case, ammonia or sodium hydroxide may be added to the hybrid resin solution for ionic dissociation of the carboxy group contained in the segment and reliable and smooth emulsification in the aqueous phase.

The aqueous medium may contain a dispersion stabilizer. Alternatively, the aqueous medium may contain a surfactant or a microparticulate resin for improving the dispersion stability of oil droplets. The dispersion stabilizer, the surfactant, and the microparticulate resin may be the same as described in the section "(Preparation of amorphous resin microparticle dispersion)".

The aforementioned dispersion treatment may be performed by use of mechanical energy with any disperser described above in the section "(Preparation of amorphous resin microparticle dispersion)".

The hybrid resin microparticles (oil droplets) in the hybrid resin microparticle dispersion prepared as described above have a volume median particle size of preferably 50 to 1,000 nm, more preferably 50 to 500 nm, still more preferably 80 to 500 nm. The volume median particle size is determined by the method described in Examples. The volume median particle size of the oil droplets can be adjusted by, for example, control of the mechanical energy during emulsification and dispersion.

The content of the hybrid resin microparticles is preferably 10 to 50 mass %, more preferably 15 to 40 mass %, relative to the entire amount (100 mass %) of the hybrid resin microparticle dispersion. A content within the above range leads to a narrow particles size distribution and an improvement in properties of the toner.

(e) Fifth Step

The fifth step involves formation of aggregated particles through fusion of the amorphous resin microparticles, the crystalline resin microparticles, and the colorant microparticles.

After the heating of the mixture of the crystalline resin microparticle dispersion, the amorphous resin microparticle dispersion, and the colorant microparticle dispersion in the third step, the agitation rate is lowered while the temperature of the mixture is maintained. In the fifth step, the agitation rate of the mixture is lowered for reducing the repulsion between particles, to promote contact between the particles and aggregation of the particles. The temperature of the mixture is preferably higher than the melting point of the crystalline resin. While the temperature of the mixture is maintained, the agitation rate is lowered to promote aggregation of the crystalline resin microparticles, the amorphous resin microparticles, and the colorant microparticles. After the particle size of the aggregated particles reaches a desired value, aggregation is stopped through addition of an aggregation stopper, such as an aqueous sodium chloride solution. The resultant aggregated particles preferably have a volume median particle size of 4.5 to 7.0 μm. The volume median particle size of the aggregated particles can be determined with an analyzer "Coulter Multisizer 3" (manufactured by Beckman Coulter, Inc.).

In the fifth step, it is preferred that aggregation be stopped through addition of an aggregation terminator and/or elevation of the agitation rate, and then the temperature of the mixture be maintained or adjusted under agitation of the mixture, to promote the fusion of toner particles until the average roundness of the particles in the mixture reaches a desired value. The particles contained in the mixture preferably have an average roundness of 0.920 to 1.000. The average roundness can be determined by the method described in Examples.

This step effectively promotes growth of the particles (i.e., aggregation of the crystalline resin microparticles, the amorphous resin microparticles, the colorant microparticles, and optional release agent microparticles) and fusion of the particles (i.e., elimination of the interface between particles), to produce toner particles having high durability.

(f) Shell-forming Step

A shell-forming step is preferably performed for preparation of toner particles having a core-shell structure.

The shell-forming step involves addition of an aqueous dispersion of a resin for forming a shell layer (preferably, the aforementioned amorphous resin) in the fifth step, and then fusion of the shell-forming resin with the surfaces of the particles prepared above (core particles) having a single-layer structure. This step produces toner particles having a core-shell structure. The shell-forming step may be followed by further heating of the reaction system until the shell-forming resin is more strongly fused with the surfaces of the core particles and the resultant particles have a desired shape. This heating may be continued until the toner particles having a core-shell structure exhibit an average roundness within the aforementioned range.

(g) Cooling Step

The cooling step involves cooling of the toner particle dispersion. The toner particle dispersion may be cooled at any rate, but the cooling rate is preferably 0.2 to 20° C./min. The toner particle dispersion may be cooled by any process, such as a process involving feeding of a cooling medium to the reactor, or a process involving direct feeding of cooling water into the reaction system.

(h) Filtration, Washing, and Drying Steps

The filtration step involves separation of toner particles from the toner particle dispersion. The filtration step may involve any technique, such as centrifugation, filtration under reduced pressure with a Nutsche filter, or filtration with a filter press.

The washing step involves removal of deposits (e.g., the surfactant and the flocculant) from the separated toner particles (caked agglomeration of toner particles). The washing step is continued until the conductivity of the washings reaches, for example, 5 to 10 μS/cm.

The drying step involves drying of the washed toner particles. Example of the dryer used in the drying step include known dryers, such as spray dryers, vacuum freeze dryers, reduced-pressure dryers, stationary shelf dryers, mobile shelf dryers, fluidized bed dryers, rotary dryers, and stirring dryers. The water content of the dried toner particles is preferably 5 mass % or less, more preferably 2 mass % or less.

If the dried toner particles are agglomerated by weak interparticle force, the agglomerated particles may be subjected to disintegration treatment. This treatment may involve the use of a mechanical disintegrator, such as a jet mill, a Henschel mixer, a coffee mill, or a food processor.

(i) Step of Addition of External Additive

This step involves optional addition of an external additive to the dried toner particles, to produce a toner. The addition of the external additive improves the fluidity, charging characteristics, and cleanability of the toner.

<<Developer>>

The toner is suitable for the following use: For example, the toner may be used as a magnetic one-component developer containing a magnetic material. Alternatively, the toner may be mixed with a carrier and used as a two-component developer. Alternatively, the toner may be used alone as a non-magnetic toner.

The carrier for forming the two-component developer may be magnetic particles composed of any known material, such as a metal material (e.g., iron, ferrite, or magnetite) or an alloy of such a metal and aluminum or lead. Ferrite particles are particularly preferred.

The carrier has a volume average particle size of preferably 15 to 100 μm, more preferably 25 to 60 μm.

The carrier is preferably coated with a resin or in the form of a dispersion of magnetic particles in a resin. Non-limiting examples of the resin for coating of the carrier include olefinic resins, cyclohexyl methacrylate-methyl methacrylate copolymers, styrenic resins, styrene-acrylic resins, silicone resins, ester resins, and fluororesins. Non-limiting examples of the resin for forming the dispersion include known resins, such as acrylic resins, styrene-acrylic resins, polyester resins, fluororesins, and phenolic resins.

<<Fixation>>

The fixation of the toner of the present invention preferably involves the use of a contact heating process. Examples of the contact heating process include a thermal pressure fixing process, a thermal roller fixing process, and a thermocompression fixing process involving the use of a rotary pressure unit including a fixed heater.

The aforementioned embodiments of the present invention should not be construed to limit the invention, and various modifications of the invention may be made.

EXAMPLES

The present invention will now be described in detail by way of examples, which should not be construed to limit the present invention. In the following examples, the term "parts" and the symbol "%" refer to "parts by mass" and "mass %," respectively, unless otherwise specified.

(Measurement of Melting Point (Tc) and Glass Transition Temperature (Tg))

The melting point and glass transition temperature of a resin for forming the toner were measured with a differential scanning calorimeter "Diamond DSC" (manufactured by PerkinElmer, Inc.). In detail, a sample of the resin (5.0 mg) was sealed in an aluminum pan and placed on a sample holder of the differential scanning calorimeter "Diamond DSC". The differential scanning calorimetry was performed by the following temperature program: a first heating process involving heating the sample from room temperature (25° C.) to 150° C. at a rate of 10° C./min and maintaining the sample at 150° C. for five minutes; a cooling process involving cooling the sample from 150° C. to 0° C. at a rate of 10° C./min and maintaining the sample at 0° C. for five minutes; and a second heating process involving heating the sample from 0° C. to 150° C. at a rate of 10° C./min. An empty aluminum pan was used as a reference.

The temperature of the melting peak (endothermic peak having a half width of 15° C. or less) of the resin in the first heating process was defined as the melting point (Tc) of the resin. For the case of an amorphous resin, the onset temperature determined in the first heating process of the aforementioned DSC analysis was defined as a glass transition temperature Tg1 (° C.), and the onset temperature determined in the second heating process was defined as a glass transition temperature Tg2 (° C.).

(Measurement of Number Average Molecular Weight (Mn) and Weight Average Molecular Weight (Mw))

The number average molecular weight (Mn) and weight average molecular weight (Mw) of a resin (in terms of polystyrene) were determined with a GPC apparatus "HLC-8220 GPC" (manufactured by Tosoh Corporation) provided with "TSKguard column and three TSKgelSuperHZM-M columns" (manufactured by Tosoh Corporation). While the column temperature was maintained at 40° C., the columns were fed with tetrahydrofuran (THF) serving as carrier solvent at a flow rate of 0.2 mL/min. A sample (crystalline resin) was dissolved in tetrahydrofuran (concentration: 1 mg/mL) under treatment with an ultrasonic disperser at room temperature for five minutes, and then filtered through a membrane filter having a pore size of 0.2 μm to prepare a sample solution. The sample solution (10 μL) and the carrier solvent were injected into the GPC apparatus, and the sample was detected with a refractive index detector (RI detector). The molecular weight distribution of the sample was then calculated from a calibration curve prepared with monodispersed polystyrene standard particles. The calibration curve was prepared with ten polystyrene standard samples (manufactured by Pressure Chemical) having molecular weights of $6\times10^2$, $2.1\times10^3$, $4\times10^3$, $1.75\times10^4$, $5.1\times10^4$, $1.1'10^5$, $3.9\times10^5$, $8.6\times10^5$, $2\times10^6$, and $4.48\times10^6$.

(Measurement of Average Particle Size of Amorphous Resin Particles and Crystalline Resin Microparticles)

The volume average particle diameter (volume median particle size) of amorphous resin microparticles or crystalline resin microparticles was determined with an analyzer "UPA-150" (manufactured by Microtrac Inc.).

Synthesis of Crystalline Polyester Resin 1

Dodecanedioic acid (281 parts by mass) and 1,6-hexanediol (283 parts by mass) were placed into a reactor equipped with an agitator, a thermometer, a cooling tube, and a nitrogen gas feeding tube. After the reactor was purged with dry nitrogen gas, $Ti(OBu)_4$ (0.1 parts by mass) was added to the mixture, and the mixture was agitated for eight hours under a nitrogen gas stream at about 180° C. for polymerization. $Ti(OBu)_4$ (0.2 parts by mass) was further added to the mixture, and the mixture was agitated for six hours at an elevated temperature of about 220° C. for polymerization. The internal pressure of the reactor was then reduced to 1333.2 Pa, and crystalline polyester resin 1 was prepared through polymerization under reduced pressure. Crystalline polyester resin 1 had a number average molecular weight (Mn) of 5,500, a number average molecular weight (Mn) of 18,000, and a melting point (Tc) of 67° C.

Preparation of Crystalline Resin Microparticle Dispersion (C1)

Crystalline polyester resin 1 (30 parts by mass) was melted and transferred to an emulsifier "Cavitron CD1010" (manufactured by EUROTEC LIMITED) at a rate of 100 parts by mass/min. Aqueous ammonia (70 parts by mass) was diluted with deionized water in an aqueous solvent tank. While being heated with a heat exchanger at 100° C., the diluted aqueous ammonia (concentration: 0.37 mass %) was transferred to the emulsifier "Cavitron CD1010" (manufactured by EUROTEC LIMITED) at a rate of 0.1 L/min simultaneous with the transfer of crystalline polyester resin 1. The emulsifier "Cavitron CD1010" (manufactured by EUROTEC LIMITED) was operated at a rotor speed of 60 Hz and a pressure of 5 kg/cm$^2$, to prepare crystalline resin microparticle dispersion (C1) of crystalline polyester resin 1 (solid content: 30 parts by mass). The particles contained in crystalline resin microparticle dispersion (C1) had a volume median particle size of 200 nm.

Preparation of Amorphous Resin Microparticle Dispersion (X1)

(1) First Polymerization Step

Sodium dodecyl sulfate (8 parts by mass) and deionized water (3,000 parts by mass) were added to a 5-L reactor equipped with an agitator, a temperature sensor, a cooling tube, and a nitrogen feeder, and the mixture was agitated at 230 rpm under a nitrogen gas stream while the internal temperature was raised to 80° C. After the temperature reached 80° C., a solution of potassium persulfate (10 parts by mass) in deionized water (200 parts by mass) was added to the reactor, and the temperature of the mixture was raised again to 80° C. The following mixture of monomers was added dropwise to the reactor over one hour, and the resultant mixture was then heated at 80° C. for two hours, to prepare resin microparticle dispersion (x1):

styrene, 480 parts by mass;

n-butyl acrylate, 250 parts by mass; and methacrylic acid, 68 parts by mass.

(2) Second Polymerization Step

A solution of sodium polyoxyethylene (2) dodecyl ether sulfate (7 parts by mass) in deionized water (3,000 parts by mass) was added to a 5-L reactor equipped with an agitator, a temperature sensor, a cooling tube, and a nitrogen feeder, and was heated to 98° C. Resin microparticle dispersion (x1) (80 parts by mass in terms of solid content) and a mixture prepared through dissolution of the following monomers and release agent at 90° C. was added to the heated solution:

styrene (St), 285 parts by mass;

n-butyl acrylate (BA), 95 parts by mass;

methacrylic acid (MAA), 20 parts by mass;

n-octyl 3-mercaptopropionate, 8 parts by mass; and release agent: behenyl behenate (melting point: 73° C.), 190 parts by mass. The resultant mixture was processed for one hour in a mechanical disperser "CLEARMIX" having a circulation path (manufactured by M Technique Co., Ltd.), to prepare a dispersion containing emulsified particles (oil droplets).

A solution of potassium persulfate (6 parts by mass) in deionized water (200 parts by mass) (i.e., a polymerization initiator solution) was added to the dispersion. The mixture was heated with agitation for one hour at 84° C. for polymerization, to prepare resin microparticle dispersion (x2).

(3) Third Polymerization Step

Deionized water (400 parts by mass) was then added to resin microparticle dispersion (x2) and thoroughly mixed. A solution of potassium persulfate (11 parts by mass) in deionized water (400 parts by mass) was added to the mixture. The composition of the following monomers was added dropwise over one hour at a temperature of 82° C.:

styrene (St), 437 parts by mass;

n-butyl acrylate (BA), 17 parts by mass;

n-octyl acrylate, 143 parts by mass;

acrylic acid (AA), 52 parts by mass; and n-octyl 3-mercaptopropionate, 8 parts by mass. After completion of the dropwise addition, the resultant mixture was heated with agitation for two hours for polymerization and was cooled to 28° C., to prepare amorphous resin microparticle dispersion (X1) of vinyl resin (styrene-acrylic resin 1).

The amorphous resin microparticles contained in amorphous resin microparticle dispersion (X1) had a volume median particle size of 220 nm, a glass transition temperature (Tg) of 46° C., and a weight average molecular weight (Mw) of 32,000.

Preparation of Colorant Microparticle Dispersion [Bk]

Sodium dodecyl sulfate (90 parts by mass) was dissolved in deionized water (1,600 parts by mass) with agitation, and carbon black "REGAL 330R" (manufactured by Cabot Corporation) (420 parts by mass) was gradually added to the solution under agitation. The resultant mixture was then processed in an agitator "CLEARMIX" (manufactured by M Technique Co., Ltd.), to prepare colorant microparticle dispersion [Bk]. The colorant microparticles contained in colorant microparticle dispersion [Bk] had a volume median particle size of 120 nm as determined with an electrophoretic light scattering photometer "ELS-800" (manufactured by Otsuka Electronics Co., Ltd.).

Preparation of Amorphous Resin Microparticle Dispersion (S1) for Shell)

The following monomers (including a bireactive monomer) for an addition-polymerization resin (styrene-acrylic resin: StAc) and radical polymerization initiator were added to a dropping funnel:

styrene, 80 parts by mass;

n-butyl acrylate, 20 parts by mass;

acrylic acid, 10 parts by mass; and polymerization initiator (di-t-butyl peroxide), 16 parts by mass.

The following monomers for a polycondensation resin (amorphous polyester resin) were added to a four-neck flask equipped with a nitrogen feeding tube, a dehydration tube, an agitator, and a thermocouple, and were dissolved at 170° C.:

propylene oxide (2 mol) adduct of bisphenol A, 285.7 parts by mass;

terephthalic acid, 66.9 parts by mass; and fumaric acid, 47.4 parts by mass.

The monomers for the addition-polymerization resin were added dropwise to the flask over 90 minutes and aged for 60 minutes, and then the unreacted monomers were removed under reduced pressure (8 kPa).

An esterification catalyst $Ti(OBu)_4$ (0.4 parts by mass) was then added to the reaction system. The reaction system was heated to 235° C. to allow the reaction to proceed under ambient pressure (101.3 kPa) for five hours, and then under reduced pressure (8 kPa) for one hour.

After the reaction system was cooled to 200° C., the reaction was continued under reduced pressure (20 kPa) until a desired softening point was achieved. The solvent was then removed to prepare resin (s1) for shell (amorphous resin). Resin (s1) for shell had a glass transition temperature (Tg) of 60° C. and a weight average molecular weight (Mw) of 30,000.

Resin (s1) for shell (100 parts by mass) was dissolved in ethyl acetate (manufactured by Kanto Chemical Co., Inc.) (400 parts by mass), and was mixed with a preliminarily prepared solution (638 parts by mass) of 0.26 mass % sodium lauryl sulfate. The mixed solution was ultrasonically dispersed with an ultrasonic homogenizer "US-150T" (manufactured by NIHONSEIKI KAISHA LTD.) at a V-LEVEL of 300 μA for 30 minutes with agitation. While the solution was maintained at 40° C., ethyl acetate was completely removed with a diaphragm vacuum pump "V-700" (manufactured by BUCHI) with agitation under reduced pressure for three hours, to prepare amorphous resin microparticle dispersion (S1) for shell (solid content: 13.5 mass %). The particles contained in amorphous resin microparticle dispersion (S1) had a volume median particle size of 160 nm.

<<Production of Toner 1 for Developing Electrostatic Images>>

Amorphous resin microparticle dispersion (X1) (288 parts by mass in terms of solid content) and deionized water (2,000 parts by mass) were added to a reactor equipped with an agitator, a temperature sensor, and a cooling tube. A 5 mol/L aqueous sodium hydroxide solution was then added to adjust the pH of the dispersion to 10 (at 25° C.)

After the pH adjustment, colorant microparticle dispersion [Bk] (30 parts by mass in terms of solid content) was added to amorphous resin microparticle dispersion (X1). An aqueous solution of magnesium chloride (i.e., a flocculant) (30 parts by mass) in deionized water (60 parts by mass) was added under agitation at 30° C. over 10 minutes. The resultant mixture was heated to 80° C., and crystalline resin microparticle dispersion (C1) of crystalline polyester resin 1 (40 parts by mass) was added to the mixture over 10 minutes for promotion of agglomeration. The particle size of associated particles was determined with a particle size analyzer "Coulter Multisizer 3" (manufactured by Beckman Coulter, Inc.). After the volume median particle size reached 6.0 μm, amorphous resin microparticle dispersion (S1) for shell (37 parts by mass in terms of solid content) was added over 30 minutes. After the supernatant of the reaction mixture became clear, an aqueous solution of sodium chloride (190 parts by mass) in deionized water (760 parts by mass) was added to stop growth of the particles. The reaction system was further heated at 80° C. with agitation to promote fusion of the particles. After the average roundness of the toner was determined to be 0.945 with a roundness analyzer "FPIA-2100" (manufactured by Sysmex Corporation) (4000 particles detected in a high-power field (HPF)), the reaction system was cooled to 30° C. at a rate of 2.5° C./min.

Toner cake was prepared by solid-liquid separation and then dehydration and was redispersed in deionized water. This operation cycle was repeated three times. The resultant product was then dried at 40° C. for 24 hours to prepare toner particles.

Hydrophobic silica (number average primary particle size: 12 nm, hydrophobicity: 68) (0.6 parts by mass) and hydrophobic titanium oxide (number average primary particle size: 20 nm, hydrophobicity: 63) (1.0 part by mass) were added to the toner particles (100 parts by mass), and were mixed with a Henschel mixer (manufactured by Nippon Coke & Engineering Co., Ltd.) at a circumferential velocity of a rotary blade of 35 mm/sec and 32° C. for 20 minutes. Coarse particles were then removed with a sieve having an opening of 45 μm. The external additives were thereby added to prepare toner 1 for developing electrostatic images.

<<Production of Toner 2 for Developing Electrostatic Images>>

Toner 2 for developing electrostatic images was produced as in toner 1, except that crystalline resin microparticle dispersion (C1) was replaced with crystalline resin microparticle dispersion (C2).

Crystalline resin microparticle dispersion (C2) was prepared as described below.

Preparation of Crystalline Polyester Resin 2

Crystalline polyester resin 2 was prepared as in crystalline polyester resin 1, except that dodecanedioic acid was replaced with tetradecanedioic acid, and 1,6-hexanediol was replaced with 1,9-nonanediol.

Preparation of Crystalline Resin Microparticle Dispersion (C2)

Crystalline resin microparticle dispersion (C2) was prepared as in crystalline resin microparticle dispersion (C1), except that crystalline polyester resin 1 was replaced with crystalline polyester resin 2. The particles contained in crystalline resin microparticle dispersion (C2) had a volume median particle size of 220 nm.

<<Production of Toner 3 for Developing Electrostatic Images>>

Toner 3 for developing electrostatic images was produced as in toner 1, except that crystalline resin microparticle dispersion (C1) was replaced with crystalline resin microparticle dispersion (C3).

Crystalline resin microparticle dispersion (C3) was prepared as described below.

Preparation of Crystalline Polyester Resin 3

Crystalline polyester resin 3 was prepared as in crystalline polyester resin 1, except that dodecanedioic acid was replaced with tetradecanedioic acid, and 1,6-hexanediol was replaced with 1,3-propanediol.

Preparation of Crystalline Resin Microparticle Dispersion (C3)

Crystalline resin microparticle dispersion (C3) was prepared as in crystalline resin microparticle dispersion (C1), except that crystalline polyester resin 1 was replaced with crystalline polyester resin 3. The particles contained in crystalline resin microparticle dispersion (C3) had a volume median particle size of 180 nm.

<<Production of Toner 4 for Developing Electrostatic Images>>

Toner 4 for developing electrostatic images was produced as in toner 1, except that crystalline resin microparticle dispersion (C1) was replaced with crystalline resin microparticle dispersion (C4).

Crystalline resin microparticle dispersion (C4) was prepared as described below.

Preparation of Crystalline Polyester Resin 4

Crystalline polyester resin 4 was prepared as in crystalline polyester resin 1, except that dodecanedioic acid was replaced with tetradecanedioic acid.

Preparation of Crystalline Resin Microparticle Dispersion (C4)

Crystalline resin microparticle dispersion (C4) was prepared as in crystalline resin microparticle dispersion (C1), except that crystalline polyester resin 1 was replaced with crystalline polyester resin 4. The particles contained in crystalline resin microparticle dispersion (C4) had a volume median particle size of 220 nm.

<<Production of Toner 5 for Developing Electrostatic Images>>

Toner 5 for developing electrostatic images was produced as in toner 1, except that crystalline resin microparticle dispersion (C1) was replaced with crystalline resin microparticle dispersion (C5).

Crystalline resin microparticle dispersion (C5) was prepared as described below.

Preparation of Crystalline Polyester Resin 5

Crystalline polyester resin 5 was prepared as in crystalline polyester resin 1, except that dodecanedioic acid was replaced with tetradecanedioic acid, and 1,6-hexanediol was replaced with 1,4-butanediol.

Preparation of Crystalline Resin Microparticle Dispersion (C5)

Crystalline resin microparticle dispersion (C5) was prepared as in crystalline resin microparticle dispersion (C1), except that crystalline polyester resin 1 was replaced with crystalline polyester resin 5. The particles contained in crystalline resin microparticle dispersion (C5) had a volume median particle size of 210 nm.

<<Production of Toner 6 for Developing Electrostatic Images>>

Toner 6 for developing electrostatic images was produced as in toner 1, except that amorphous resin microparticle dispersion (X1) was replaced with amorphous resin microparticle dispersion (X2).

Amorphous resin microparticle dispersion (X2) was prepared as described below.

Preparation of Amorphous Resin Microparticle Dispersion (X2)

Amorphous resin microparticle dispersion (X2) was prepared as in amorphous resin microparticle dispersion (X1), except that the composition of monomers used in the third polymerization step was modified as follows:

styrene (St), 455 parts by mass;

n-butyl acrylate (BA), 0 parts by mass;

2-ethylhexyl acrylate, 143 parts by mass;

acrylic acid (AA), 52 parts by mass; and n-octyl 3-mercaptopropionate, 8 parts by mass.

<<Production of Toner 7 for Developing Electrostatic Images>>

Toner 7 for developing electrostatic images was produced as in toner 1, except that crystalline resin microparticle dispersion (C1) was replaced with crystalline resin microparticle dispersion (C6).

Crystalline resin microparticle dispersion (C6) was prepared as described below.

Preparation of Crystalline Polyester Resin 6

Crystalline polyester resin 6 was prepared as in crystalline polyester resin 1, except that dodecanedioic acid was replaced with adipic acid, and 1,6-hexanediol was replaced with 1,12-dodecanediol.

Preparation of Crystalline Resin Microparticle Dispersion (C6)

Crystalline resin microparticle dispersion (C6) was prepared as in crystalline resin microparticle dispersion (C1), except that crystalline polyester resin 1 was replaced with crystalline polyester resin 6. The particles contained in crystalline resin microparticle dispersion (C6) had a volume median particle size of 200 nm.

<<Production of Toner 8 for Developing Electrostatic Images>>

Toner 8 for developing electrostatic images was produced as in toner 1, except that crystalline resin microparticle dispersion (C1) was replaced with crystalline resin microparticle dispersion (C7).

Crystalline resin microparticle dispersion (C7) was prepared as described below.

Synthesis of Crystalline Polyester Resin 7

The following monomers (including a bireactive monomer) for an addition-polymerization resin (styrene-acrylic resin: StAc) and radical polymerization initiator were added to a dropping funnel:

styrene, 34 parts by mass;

n-butyl acrylate, 12 parts by mass;

acrylic acid, 2 parts by mass; and polymerization initiator (di-t-butyl peroxide), 7 parts by mass.

The following monomers for a polycondensation resin (crystalline polyester resin: CPEs) were added to a four-neck flask equipped with a nitrogen feeding tube, a dehydration tube, an agitator, and a thermocouple, and were dissolved at 170° C.:

dodecanedioic acid, 281 parts by mass; and 1,6-hexanediol, 283 parts by mass.

The monomers for the addition-polymerization resin (StAc) were added dropwise to the flask over 90 minutes and aged for 60 minutes, and then the unreacted monomers were removed under reduced pressure (8 kPa). The ratio of the amount of the removed monomers to that of the added monomers was very low.

An esterification catalyst $Ti(OBu)_4$ (0.8 parts by mass) was then added to the reaction system. The reaction system was heated to 235° C. to allow the reaction to proceed under ambient pressure (101.3 kPa) for five hours, and then under reduced pressure (8 kPa) for one hour.

After the reaction system was cooled to 200° C., the reaction was continued under reduced pressure (20 kPa) for one hour, to prepare crystalline polyester resin 7 (i.e., hybrid crystalline polyester resin). The content of StAc was 8 mass % relative to the entire amount of Crystalline polyester resin 7. Crystalline polyester resin 7 had a structure composed of CPEs grafted to StAc. Crystalline polyester resin 7 had a number average molecular weight (Mn) of 5,000 and a melting point (Tc) of 65° C.

Preparation of Crystalline Resin Microparticle Dispersion (C7)

Crystalline resin microparticle dispersion (C7) was prepared as in crystalline resin microparticle dispersion (C1), except that crystalline polyester resin 1 was replaced with crystalline polyester resin 7. The particles contained in crystalline resin microparticle dispersion (C7) had a volume median particle size of 230 nm.

<<Production of Toner 9 for Developing Electrostatic Images>>

Amorphous resin microparticle dispersion (X1) (325 parts by mass in terms of solid content) and deionized water (2,000 parts by mass) were added to a reactor equipped with an agitator, a temperature sensor, and a cooling tube. A 5 mol/L aqueous sodium hydroxide solution was then added to adjust the pH of the dispersion to 10 (at 25° C.)

After the pH adjustment, colorant microparticle dispersion [Bk] (30 parts by mass in terms of solid content) was added to amorphous resin microparticle dispersion (X1). An aqueous solution of magnesium chloride (i.e., a flocculant) (34 parts by mass) in deionized water (60 parts by mass) was added under agitation at 30° C. over 10 minutes. The resultant mixture was heated to 80° C., and crystalline resin microparticle dispersion (C1) of crystalline polyester resin 1 (40 parts by mass) was added to the mixture over 10 minutes for promotion of agglomeration. The particle size of associated particles was determined with a particle size analyzer "Coulter Multisizer 3" (manufactured by Beckman Coulter, Inc.). After the volume median particle size reached 6.0 μm, an aqueous solution of sodium chloride (190 parts by mass) in deionized water (760 parts by mass) was added to stop growth of the particles. The reaction system was further heated at 80° C. with agitation to promote fusion of the particles. After the average roundness of the toner was determined to be 0.945 with a roundness analyzer "FPIA- 2100" (manufactured by Sysmex Corporation) (4000 particles detected in a high-power field (HPF)), the reaction system was cooled to 30° C. at a rate of 2.5° C./min.

Toner cake was prepared by solid-liquid separation and then dehydration, and was redispersed in deionized water. This operation cycle was repeated three times. The resultant product was then dried at 40° C. for 24 hours to prepare toner particles.

Hydrophobic silica (number average primary particle size: 12 nm, hydrophobicity: 68) (0.6 parts by mass) and hydrophobic titanium oxide (number average primary particle size: 20 nm, hydrophobicity: 63) (1.0 part by mass) were added to the toner particles (100 parts by mass), and were mixed with a Henschel mixer (manufactured by Nippon Coke & Engineering Co., Ltd.) at a circumferential velocity of a rotary blade of 35 mm/sec and 32° C. for 20 minutes. Coarse particles were then removed with a sieve having an opening of 45 μm. The external additives were thereby added to prepare toner 9 for developing electrostatic images.

<<Production of Toner 10 for Developing Electrostatic Images>>

Toner 10 for developing electrostatic images was produced as in toner 1, except that amorphous resin microparticle dispersion (X1) was replaced with amorphous resin microparticle dispersion (X3).

Amorphous resin microparticle dispersion (X3) was prepared as described below.

Preparation of Amorphous Resin Microparticle Dispersion (X3)

Amorphous resin microparticle dispersion (X3) was prepared as in amorphous resin microparticle dispersion (X1), except that the composition of monomers used in the third polymerization step was modified as follows:

styrene (St), 304 parts by mass;
n-butyl acrylate (BA), 8 parts by mass;
2-ethylhexyl methacrylate, 286 parts by mass;
acrylic acid (AA), 52 parts by mass; and
n-octyl 3-mercaptopropionate, 8 parts by mass.

<<Production of Toner 11 for Developing Electrostatic Images>>

Toner 11 for developing electrostatic images was produced as in toner 1, except that amorphous resin microparticle dispersion (X1) was replaced with amorphous resin microparticle dispersion (X4).

Amorphous resin microparticle dispersion (X4) was prepared as described below.

Preparation of Amorphous Resin Microparticle Dispersion (X4)

Amorphous resin microparticle dispersion (X4) was prepared as in amorphous resin microparticle dispersion (X1), except that the composition of monomers used in the third polymerization step was modified as follows:

styrene (St), 357 parts by mass;
n-butyl acrylate (BA), 97 parts by mass;
lauryl acrylate, 143 parts by mass;
acrylic acid (AA), 52 parts by mass; and
n-octyl 3-mercaptopropionate, 8 parts by mass.

<<Production of Toner 12 for Developing Electrostatic Images>>

Toner 12 for developing electrostatic images was produced as in toner 1, except that amorphous resin microparticle dispersion (X1) was replaced with amorphous resin microparticle dispersion (X5).

Amorphous resin microparticle dispersion (X5) was prepared as described below.

Preparation of Amorphous Resin Microparticle Dispersion (X5)

Amorphous resin microparticle dispersion (X5) was prepared as in amorphous resin microparticle dispersion (X1), except that the composition of monomers used in the third polymerization step was modified as follows:

styrene (St), 323 parts by mass;
n-butyl acrylate (BA), 132 parts by mass;
stearyl acrylate, 143 parts by mass;
acrylic acid (AA), 52 parts by mass; and
n-octyl 3-mercaptopropionate, 8 parts by mass.

<<Production of Toner 13 for Developing Electrostatic Images>>

Toner 13 for developing electrostatic images was produced as in toner 1, except that amorphous resin microparticle dispersion (X1) was replaced with amorphous resin microparticle dispersion (X6).

Amorphous resin microparticle dispersion (X6) was prepared as described below.

Preparation of Amorphous Resin Microparticle Dispersion (X6)

Amorphous resin microparticle dispersion (X6) was prepared as in amorphous resin microparticle dispersion (X1), except that the composition of monomers used in the third polymerization step was modified as follows:

styrene (St), 308 parts by mass;
n-butyl acrylate (BA), 147 parts by mass;
behenyl acrylate, 143 parts by mass;
acrylic acid (AA), 52 parts by mass; and
n-octyl 3-mercaptopropionate, 8 parts by mass.

<<Production of Toner 14 for Developing Electrostatic Images>>

Toner 14 for developing electrostatic images was produced as in toner 1, except that crystalline resin microparticle dispersion (C1) was replaced with crystalline resin microparticle dispersion (C8).

Crystalline resin microparticle dispersion (C8) was prepared as described below.

Preparation of Crystalline Polyester Resin 8

Crystalline polyester resin 8 was prepared as in crystalline polyester resin 1, except that 1,6-hexanediol was replaced with 1,9-nonanediol.

Preparation of Crystalline Resin Microparticle Dispersion (C8)

Crystalline resin microparticle dispersion (C8) was prepared as in crystalline resin microparticle dispersion (C1), except that crystalline polyester resin 1 was replaced with crystalline polyester resin 8. The particles contained in crystalline resin microparticle dispersion (C8) had a volume median particle size of 225 nm.

<<Production of Toner 15 for Developing Electrostatic Images>>

Toner 15 for developing electrostatic images was produced as in toner 1, except that crystalline resin microparticle dispersion (C1) was replaced with crystalline resin microparticle dispersion (C9).

Crystalline resin microparticle dispersion (C9) was prepared as described below.

Preparation of Crystalline Polyester Resin 9

Crystalline polyester resin 9 was prepared as in crystalline polyester resin 1, except that dodecanedioic acid was replaced with octadecanedioic acid, and 1,6-hexanediol was replaced with 1,4-butanediol.

Preparation of Crystalline Resin Microparticle Dispersion (C9)

Crystalline resin microparticle dispersion (C9) was prepared as in crystalline resin microparticle dispersion (C1), except that crystalline polyester resin 1 was replaced with crystalline polyester resin 9. The particles contained in crystalline resin microparticle dispersion (C9) had a volume median particle size of 240 nm.

<<Production of Toner 16 for Developing Electrostatic Images>>

Toner 16 for developing electrostatic images was produced as in toner 1, except that amorphous resin microparticle dispersion (X1) was replaced with amorphous resin microparticle dispersion (X7).

Amorphous resin microparticle dispersion (X7) was prepared as described below.

Preparation of Amorphous Resin Microparticle Dispersion (X7)

Amorphous resin microparticle dispersion (X7) was prepared as in amorphous resin microparticle dispersion (X1), except that the composition of monomers used in the third polymerization step was modified as follows:

styrene (St), 420 parts by mass;

n-butyl acrylate (BA), 178 parts by mass;

acrylic acid (AA), 52 parts by mass; and n-octyl 3-mercaptopropionate, 8 parts by mass.

<<Evaluation of Toners 1 to 16 for Developing Electrostatic Images>>

<Preparation of Developer>

Two samples were prepared for each of toners 1 to 16 for developing electrostatic images. One of the samples was stored at 20° C. and 50% RH for 24 hours (condition (1)), and the other sample was stored at 50° C. and 40% RH for 24 hours (condition (2)). These toner samples were mixed with a silicone resin-coated ferrite carrier having a volume median particle size ($d_{50}$) of 60 μm (toner concentration of the mixture: 6.50 mass %), to prepare developers.

<Evaluation of Low-Temperature Fixing Properties (Under Offset)>

The under offset is an image defect involving detachment of a toner from a transfer medium (e.g., a sheet) due to insufficient fusion of the toner heated by a fixing device.

For evaluation of low-temperature fixing properties, the resultant developers were placed in an image-forming device, and unfixed solid images (toner density: 11.3 g/m$^2$) were formed on sheets NPI (grammage: 128 g/m$^2$) (manufactured by Nippon Paper Industries Co., Ltd.) with the image-forming device under ambient conditions (20° C., 50% RH). The surface of a pressure roller of the fixing device was heated to 100° C., and the surface temperature of a heating roller was varied stepwise from 140° C. to 180° C. in 2° C. increments, to fix the solid images to the sheets. The temperature of a fixing belt was measured during fixation, and the minimum fixing temperature at which no under offset occurred was determined. The minimum fixing temperature was determined for the developers prepared from the toner samples stored at the aforementioned different conditions. The developers were evaluated for low-temperature fixing properties and fixing properties after storage at high temperature. The fixing properties were evaluated on the basis of the criteria described below.

(Evaluation of Low-temperature Fixing Properties)

A developer was acceptable which was prepared from a toner stored at 20° C. and 50% RH for 24 hours and had a minimum fixing temperature of 160° C. or lower. A lower minimum fixing temperature indicates superior low-temperature fixing properties.

A: A minimum fixing temperature of lower than 156° C.

B: A minimum fixing temperature of 156 to 160° C.

C: A minimum fixing temperature of higher than 160° C.

(Evaluation of Fixing Properties After Storage at High Temperature).

The minimum fixing temperature of a developer prepared from a toner stored at 20° C. and 50% RH for 24 hours was determined, and the minimum fixing temperature of a developer prepared from a toner stored at 50° C. and 40% RH for 24 hours was determined. A difference in minimum fixing temperature between the developers of 4° C. or less was acceptable. A smaller difference in minimum fixing temperature indicates a more stable fixing property after storage at high temperature.

A: A difference in minimum fixing temperature of 0° C.

B: A difference in minimum fixing temperature of 2° C. or 4° C.

C: A difference in minimum fixing temperature of more than 4° C.

TABLE 1

| Toner for developing electrostatic images No. | Amorphous resin: Amorphous resin microparticle dispersion No. | Amorphous resin: Alkyl meth(acrylate) monomer: Monomer compound | $R_1$ | $R_2$ | Branched structure | Crystalline resin: Crystalline resin microparticle dispersion No. | Crystalline resin: Crystalline polyester resin: $C_{acid}$ | $C_{alcohol}$ |
|---|---|---|---|---|---|---|---|---|
| 1 | X1 | n-Octyl acrylate | H | $C_8H_{17}$ | Not branched | C1 | 12 | 6 |
| 2 | X1 | n-Octyl acrylate | H | $C_8H_{17}$ | Not branched | C2 | 14 | 9 |
| 3 | X1 | n-Octyl acrylate | H | $C_8H_{17}$ | Not branched | C3 | 14 | 3 |

TABLE 1-continued

| | | | | | | | | |
|---|---|---|---|---|---|---|---|---|
| 4 | X1 | n-Octyl acrylate | H | $C_8H_{17}$ | Not branched | C4 | 14 | 6 |
| 5 | X1 | n-Octyl acrylate | H | $C_8H_{17}$ | Not branched | C5 | 14 | 4 |
| 6 | X2 | 2-Ethylhexyl acrylate | H | $C_8H_{17}$ | Branched | C1 | 12 | 6 |
| 7 | X1 | n-Octyl acrylate | H | $C_8H_{17}$ | Not branched | C6 | 6 | 12 |
| 8 | X1 | n-Octyl acrylate | H | $C_8H_{17}$ | Not branched | C7 | 12 | 6 |
| 9 | X1 | n-Octyl acrylate | H | $C_8H_{17}$ | Not branched | C1 | 12 | 6 |
| 10 | X3 | 2-Ethylhexyl (meth)acrylate | $CH_3$ | $C_8H_{17}$ | Branched | C1 | 12 | 6 |
| 11 | X4 | Lauryl acrylate | H | $C_{12}H_{25}$ | Not branched | C1 | 12 | 6 |
| 12 | X5 | Stearyl acrylate | H | $C_{18}H_{37}$ | Not branched | C1 | 12 | 6 |
| 13 | X6 | Behenyl acrylate | H | $C_{22}H_{45}$ | Not branched | C1 | 12 | 6 |
| 14 | X1 | n-Octyl acrylate | H | $C_8H_{17}$ | Not branched | C8 | 12 | 9 |
| 15 | X1 | n-Octyl acrylate | H | $C_8H_{17}$ | Not branched | C9 | 18 | 4 |
| 16 | X7 | n-Butyl acrylate | H | $C_4H_9$ | Not branched | C1 | 12 | 6 |

| Toner for developing electrostatic images No. | Crystalline resin Crystalline polyester resin $\lvert C_{acid} - C_{alcohol} \rvert$ | Hybridization | Formation of shell | Evaluation of low-temperature fixing properties (※1) Minimum fixing temperature of developer [° C.] | Results of evaluation | Evaluation of fixing properties after storage at high temperature (※2) Minimum fixing temperature of developer [° C.] | Results of evaluation | Note |
|---|---|---|---|---|---|---|---|---|
| 1 | 6 | Not hybridized | Formed | 146 | A | 146 | A | Present Invention |
| 2 | 5 | Not hybridized | Formed | 152 | A | 154 | B | Present Invention |
| 3 | 11 | Not hybridized | Formed | 156 | B | 158 | B | Present Invention |
| 4 | 8 | Not hybridized | Formed | 150 | A | 150 | A | Present Invention |
| 5 | 10 | Not hybridized | Formed | 148 | A | 148 | A | Present Invention |
| 6 | 6 | Not hybridized | Formed | 146 | A | 146 | A | Present Invention |
| 7 | 6 | Not hybridized | Formed | 152 | A | 154 | B | Present Invention |
| 8 | 6 | Hybridized | Formed | 144 | A | 144 | A | Present Invention |
| 9 | 6 | Not hybridized | Not formed | 156 | B | 158 | B | Present Invention |
| 10 | 6 | Not hybridized | Formed | 154 | A | 156 | B | Present Invention |
| 11 | 6 | Not hybridized | Formed | 154 | A | 156 | B | Present Invention |
| 12 | 6 | Not hybridized | Formed | 156 | B | 160 | B | Present Invention |
| 13 | 6 | Not hybridized | Formed | 160 | B | 164 | B | Present Invention |
| 14 | 3 | Not hybridized | Formed | 160 | B | 174 | C | Comparative Example |
| 15 | 14 | Not hybridized | Formed | 160 | B | 170 | C | Comparative Example |
| 16 | 6 | Not hybridized | Formed | 160 | B | 178 | C | Comparative Example |

※1 Use of toner stored at 20° C. for 24 hours
※2 Use of toner stored at 50° C. for 24 hours As illustrated in Table 1, toners 1 to 13 for developing electrostatic images according to the present invention exhibit superior low-temperature fixing properties and stable fixing properties after storage at high temperature. In contrast, toners 14 to 16 for developing electrostatic images (i.e., toners of Comparative Examples) exhibit fixing properties inferior to those of toners 1 to 13 of the present invention.

What is claimed is:

1. A toner for developing electrostatic images, comprising:

a toner particle comprising a binder resin and a release agent, the binder resin comprising a vinyl resin component and a crystalline polyester resin component, the vinyl resin component having a structural unit derived from an alkyl (meth)acrylate monomer represented by Formula (1):

$$H_2C{=}CR_1{-}COOR_2 \quad \text{Formula (1):}$$

where $R_1$ represents a hydrogen atom or a methyl group, and $R_2$ represents an alkyl group having 8 to 22 carbon atoms, the crystalline polyester resin component satisfying Formula (2):

$$5 \leq |C_{acid} - C_{alcohol}| \leq 12 \quad \text{Formula (2):}$$

where $C_{alcohol}$ represents the number of carbon atoms of the main chain of a structural unit derived from a polyhydric alcohol forming the crystalline polyester resin component and $C_{acid}$ represents the number of carbon atoms of the main chain of a structural unit derived from a polyvalent carboxylic acid forming the crystalline polyester resin component, wherein the $C_{alcohol}$ is 3 to 12, and the $C_{acid}$ is 6 to 14, the polyhydric alcohol is an aliphatic diol, and the polyvalent carboxylic acid is an aliphatic dicarboxylic acid, and the crystalline polyester resin component has a melting point of 50 to 90° C., a weight average molecular weight of 5,000 to 50,000, and a number average molecular weight of 2,000 to 10,000.

2. The toner for developing electrostatic images according to claim 1, wherein the crystalline polyester resin component satisfies Formula (3):

$$6 \leq |C_{acid} - C_{alcohol}| \leq 10. \quad \text{Formula (3):}$$

3. The toner for developing electrostatic images according to claim 1, wherein the alkyl (meth)acrylate monomer has a branched structure.

4. The toner for developing electrostatic images according to claim 1, wherein the crystalline polyester resin component satisfies Formula (4):

$$C_{alcohol} < C_{acid}, \quad \text{Formula (4):}$$

5. The toner for developing electrostatic images according to claim 1, wherein the crystalline polyester resin component comprises a hybrid crystalline polyester resin component comprising a crystalline polyester resin segment bonded to an amorphous resin segment.

6. The toner for developing electrostatic images according to claim 1, wherein the binder resin comprises an amorphous polyester resin component.

7. The toner for developing electrostatic images according to claim 6, wherein the amorphous polyester resin component comprises a styrene-acrylic modified polyester resin.

8. The toner for developing electrostatic images according to claim 1, wherein $R_2$ of Formula (1) is an alkyl group having eight carbon atoms.

9. The toner for developing electrostatic images according to claim 1, wherein the toner particle has a core-shell structure comprising a core particle coated with a shell layer.

* * * * *